US012758059B2

(12) United States Patent
Kobs et al.

(10) Patent No.: US 12,758,059 B2
(45) Date of Patent: Oct. 13, 2026

(54) AUTOMATED FLUID DISPENSER(S) AND CORRESPONDING METHODS FOR ADAPTIVE FLUID DISPENSING

(71) Applicant: GPCP IP Holdings LLC, Atlanta, GA (US)

(72) Inventors: Stephen Russel Kobs, Greenville, WI (US); Ryan Anthony Goltz, Neenah, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 183 days.

(21) Appl. No.: 18/898,693

(22) Filed: Sep. 27, 2024

(65) Prior Publication Data

US 2025/0098909 A1 Mar. 27, 2025

Related U.S. Application Data

(60) Provisional application No. 63/540,687, filed on Sep. 27, 2023.

(51) Int. Cl.
*A47K 5/12* (2006.01)
*A47K 5/13* (2006.01)

(52) U.S. Cl.
CPC ..... *A47K 5/1217* (2013.01); *A47K 5/13* (2013.01)

(58) Field of Classification Search
USPC ..... 222/52
See application file for complete search history.

(56) References Cited

U.S. PATENT DOCUMENTS

| | | | | |
|---|---|---|---|---|
| 4,141,091 | A | 2/1979 | Pulvari | |
| 6,206,238 | B1 * | 3/2001 | Ophardt | A47K 5/1217 222/638 |
| 6,695,246 | B1 | 2/2004 | Elliott et al. | |
| 6,977,588 | B2 | 12/2005 | Schotz et al. | |
| 7,044,421 | B1 | 5/2006 | Hoyt | |
| 7,296,765 | B2 | 11/2007 | Rodrian | |
| 7,325,767 | B2 | 2/2008 | Elliott et al. | |
| 7,370,824 | B1 | 5/2008 | Chang | |

(Continued)

FOREIGN PATENT DOCUMENTS

| | | | |
|---|---|---|---|
| DE | 4106539 | C2 | 12/1994 |
| EP | 3627191 | A1 | 3/2020 |

(Continued)

*Primary Examiner* — Paul R Durand
*Assistant Examiner* — Michael J. Melaragno

(57) ABSTRACT

Systems, apparatuses, and methods for adaptive dispensing of fluid with a dispenser are provided herein. A dispenser comprises a housing with a reservoir for storing a fluid and a dispensing mechanism for dispensing a portion of the fluid from the reservoir through an outlet. The dispenser further includes a first sensor configured to sense an object and a second sensor configured to sense the object, wherein the second sensor is different than the first sensor. A controller is configured to receive data from the first sensor that is indicative of an environmental condition and determine whether the first sensor is in an unreliable state based thereon. The controller is further configured, in an instance in which the first sensor is determined to be in the unreliable state, cause the dispensing mechanism to operate to dispense the portion of the fluid in response to sensing the object via the second sensor.

26 Claims, 18 Drawing Sheets

(56) References Cited

U.S. PATENT DOCUMENTS

| | | | |
|---|---|---|---|
| 7,398,944 | B2 | 7/2008 | Lewis et al. |
| 7,523,885 | B2 | 4/2009 | Lewis |
| 7,554,084 | B2 | 6/2009 | Mok et al. |
| 7,795,584 | B2 | 9/2010 | Mok et al. |
| 7,931,228 | B2 | 4/2011 | Omdoll |
| 7,963,475 | B2 | 6/2011 | Rodrian |
| 8,224,480 | B2 | 7/2012 | Mok |
| 8,586,925 | B2 | 11/2013 | Willden |
| 8,796,624 | B2 | 8/2014 | Mok et al. |
| 8,813,999 | B2 | 8/2014 | Cittadino |
| 9,068,326 | B2 | 6/2015 | Chen |
| 9,370,283 | B2 | 6/2016 | Fellhoelter |
| 9,417,734 | B2 | 8/2016 | Raynor |
| 9,867,509 | B2 | 1/2018 | Hlushchenko et al. |
| 9,943,195 | B2 | 4/2018 | Murphy |
| 10,330,821 | B2 | 6/2019 | Wegelin et al. |
| 10,517,443 | B2 | 12/2019 | Diamond |
| 10,791,886 | B2 | 10/2020 | Borke |
| 11,069,217 | B2 | 7/2021 | Wegelin |
| 11,106,232 | B2 | 8/2021 | Wegelin |
| 11,409,021 | B2 | 8/2022 | Wegelin et al. |
| 11,715,365 | B2 | 8/2023 | Laufer |
| 11,796,715 | B2 | 10/2023 | Mo |
| 11,839,338 | B2 | 12/2023 | Lang |
| 11,844,468 | B2 | 12/2023 | Elfstrom |
| 11,910,964 | B2 | 2/2024 | Osborne, Jr. |
| 2011/0017769 | A1* | 1/2011 | Ophardt ..... A47K 5/1217 4/628 |
| 2012/0312853 | A1 | 12/2012 | Osborne |
| 2014/0001303 | A1 | 1/2014 | Tramontina et al. |
| 2014/0069951 | A1 | 3/2014 | Schmidt |
| 2016/0353946 | A1 | 12/2016 | Osborne, Jr. |
| 2020/0055658 | A1* | 2/2020 | Casper ..... B65D 83/76 |
| 2020/0138246 | A1 | 5/2020 | Wegelin |
| 2022/0015584 | A1* | 1/2022 | Khan ..... G06K 7/1413 |
| 2022/0079394 | A1 | 3/2022 | Murphy |
| 2022/0346606 | A1 | 11/2022 | Lewis |
| 2022/0373709 | A1 | 11/2022 | Wegelin et al. |
| 2023/0284841 | A1 | 9/2023 | Laitala |
| 2024/0100800 | A1 | 3/2024 | Wetsch |

FOREIGN PATENT DOCUMENTS

| | | | |
|---|---|---|---|
| EP | 3180640 | B1 | 5/2022 |
| JP | 6802784 | B2 | 12/2020 |
| TW | M385725 | U | 8/2010 |
| WO | 2014001944 | A1 | 1/2014 |
| WO | 2015066644 | A2 | 5/2015 |
| WO | 2023078739 | A1 | 5/2023 |

* cited by examiner

AUTOMATED FLUID DISPENSER(S) AND CORRESPONDING METHODS FOR ADAPTIVE FLUID DISPENSING

CROSS-REFERENCE TO RELATED APPLICATION(S)

This application claims priority to U.S. Provisional Application No. 63/540,687, filed Sep. 27, 2023, entitled "Automated Fluid Dispenser(s) and Corresponding Methods for Adaptive Fluid Dispensing", the contents of which is incorporated by reference herein in its entirety.

FIELD OF THE INVENTION

Example embodiments of the present invention generally relate to automated fluid dispensers and, more particularly to, automated fluid dispensers that are operable regardless of lighting conditions.

BACKGROUND

Fluid dispensers (e.g., skincare product dispensers) are often provided in washrooms, in bathrooms, on work sites, and at other locations for providing a fluid (e.g., liquid, gel, foam etc.), such as a soap, sanitizer, lotion, or shampoo for personal care. The dispensers may include a dispenser housing and a reservoir filled with a fluid, along with a dispensing mechanism. Some fluid dispensers are automated in that one or more dispensing mechanisms may automate a dispensing action based on sensed user input to an activation sensor.

Many fluid dispensers are provided in controlled lighting environments, such as in bathroom environments with typical lighting conditions (e.g., the lighting conditions of most bathroom environments are similar). Infrared sensors may be useful to detect a presence of an object, such as a human hand, in order to determine whether to dispense a portion of the fluid. However, in adverse lighting conditions, such as when too much ambient light is present, a circuit of the infrared sensor can become saturated such that it can no longer accurately detect a presence of an object (e.g., the sensor may become unreliable in accurately determining that a dispense is requested). For example, when an infrared sensor is placed outdoors, a circuit of the infrared sensor may become saturated due to sunlight, which may be variable. Saturation of an infrared sensor's circuit can cause the infrared sensor to give inaccurate (e.g., unreliable) readings or, in some instances, can cause the infrared sensor to be inoperable altogether.

Accordingly, a need exists for alternative dispensing apparatuses and systems for fluid dispensers, such as may assist in dispensing in adverse lighting conditions.

BRIEF SUMMARY

Various example embodiments of the present invention provide systems, apparatuses, and methods for enabling proper dispensing of a fluid dispenser regardless of the environmental condition. In this regard, in some embodiments, the fluid dispenser may switch between two different user activation sensors to trigger a dispense, such as switching between using a first sensor, for example an infrared sensor, and using a second sensor, for example, a capacitive sensor, depending on a detected status of the sensor(s), such as due to an environmental condition, for example, ambient light. Some example embodiments of the fluid dispenser provide a robust user activation approach for the dispenser that provides for using a more preferred infrared sensor when the lighting conditions are such that the sensor is not saturated but offers the capacitive sensor as a back-up user activation sensor. In some cases, the capacitive sensor may be designed for sensing directly underneath a dispensing area of the fluid dispenser, which corresponds to the placement position of the user's hand(s)—thereby helping to ensure proper detection and dispensing.

Notably, an important aspect of fluid dispensers is that the fluid must remain within the dispenser (e.g., the reservoir) before dispensing for use to a user. This is different than sheet product dispensers where the sheet product may be left hanging (e.g., after a dispense occurs). This presents unique challenges in adverse environmental conditions, for example lighting conditions, because the fluid dispenser cannot simply blind-dispense the fluid (as it would fall onto the floor). Instead, some example embodiments of the present invention provide a different user activation sensor that is not dependent on the same environmental condition (e.g., ambient lighting conditions) and uses logic to determine which sensor to utilize when determining whether to initiate a dispense—thereby providing dispensing capability in any environmental condition.

In some embodiments, a fluid dispenser with a reservoir, dispensing mechanism, and controller is designed to determine whether a first sensor or a second sensor should be used to detect a presence of an object. Some such example fluid dispensers determine whether the first sensor is unreliable (e.g., partially or fully saturated with ambient light or otherwise unable to perform the desired sensing function), and in instances in which the first sensor is unreliable, the controller may be configured to cause the second sensor, and not the first sensor, to be used to sense whether the object is present within a dispensing area. Further, in instances in which the first sensor is determined to be reliable (e.g., not saturated with ambient light), the controller may be configured to cause the first sensor, and not the second sensor, to be used to sense whether the object is present for initiating a dispense.

In some embodiments, the fluid dispenser may have a controller configured to operate one or more of the sensors according to various dispense determination methods. In some embodiments, the dispense determination methods may be designed to accurately confirm the need for a dispense, particularly in situations where the lighting conditions might otherwise cause false readings. For example, when using an infrared user activation sensor, the dispense determination method may include a dark period that helps weed out false hits—thereby avoiding unnecessary dispensing (which can be costly and messy). Additional features are also contemplated and described herein.

In an example embodiment, a dispenser is provided. The dispenser comprises a reservoir configured to store a fluid and a dispensing mechanism configured to dispense a portion of the fluid from the reservoir through an outlet. The dispenser further includes a first sensor configured to sense an object; a second sensor configured to sense the object, wherein the second sensor is different than the first sensor; and a controller. The controller is configured to: receive data from the first sensor, wherein the data is indicative of an environmental condition; determine whether the first sensor is in an unreliable state based on the data received from the first sensor; and in an instance in which the first sensor is determined to be in the unreliable state, cause the dispensing mechanism to operate to dispense the portion of the fluid in response to sensing the object via the second sensor.

In some embodiments, sensing the object via the second sensor comprises detecting a change within a sensing field of the second sensor.

In some embodiments, the controller is configured to determine whether the first sensor is in the unreliable state by: determining if a level of ambient light in an environment surrounding the dispenser exceeds a predetermined threshold; and in an instance in which the level of ambient light exceeds the predetermined threshold, determining that the first sensor is in the unreliable state. In some embodiments, determining if the level of ambient light in the environment surrounding the dispenser exceeds the predetermined threshold comprises measuring an analog signal of a receiver within a circuit of the first sensor, wherein the analog signal varies depending on an amount of ambient light sensed by the receiver; and comparing the analog signal to a predetermined range. In some embodiments, the analog signal indicates a voltage level, and the predetermined range is a voltage range.

In some embodiments, the controller is further configured to determine that the first sensor is in a reliable state by receiving a signal pulse corresponding to sensing the object at the first sensor; and cause, in response to receiving the signal pulse at the first sensor, the dispensing mechanism to operate to dispense the portion of the fluid.

In some embodiments, the second sensor is positioned proximate the outlet.

In some embodiments, the first sensor is one of an infrared sensor, a time-of-flight sensor, a break beam sensor, an optical sensor, a capacitive sensor, an ultrasonic sensor, a radar sensor, a LiDAR sensor, an image sensor, a passive infrared sensor, or a camera. In some embodiments, the second sensor is a capacitive sensor.

In another example embodiment, a dispenser is provided. The dispenser comprises a reservoir configured to store a fluid and a dispensing mechanism configured to dispense a portion of the fluid from the reservoir through an outlet. The dispenser further includes a first sensor configured to sense an object; a second sensor configured to sense the object, wherein the second sensor is a type of sensor that is different than the first sensor; and a controller. The controller is configured to determine that the first sensor is in an unreliable state, and in an instance in which the first sensor is determined to be in the unreliable state, cause the dispensing mechanism to dispense the portion of the fluid based on detection of the object by the second sensor and not based on detection of the object by the first sensor.

In some embodiments, the second sensor is positioned proximate the outlet.

In some embodiments, the controller is configured to determine that the first sensor is in the unreliable state by: determining if a level of ambient light in an environment surrounding the dispenser exceeds a predetermined threshold; and in an instance in which the level of ambient light exceeds the predetermined threshold, determining that the first sensor is in the unreliable state. In some embodiments, determining if the level of ambient light in the environment surrounding the dispenser exceeds the predetermined threshold comprises measuring an analog signal of a receiver within a circuit of the first sensor, wherein the analog signal varies depending on an amount of ambient light sensed by the receiver; and comparing the analog signal to a predetermined range. In some embodiments, the analog signal indicates a voltage level, and the predetermined range is a voltage range.

In some embodiments, the controller is further configured to determine that the first sensor is in a reliable state and thereafter cause the dispensing mechanism to dispense the portion of the fluid based on receiving a signal pulse at the first sensor and not based on the detection of the object by the second sensor.

In some embodiments, the first sensor is one of an infrared sensor, a time-of-flight sensor, a break beam sensor, an optical sensor, a capacitive sensor, an ultrasonic sensor, a radar sensor, a LiDAR sensor, an image sensor, a passive infrared sensor, or a camera. In some embodiments, the second sensor is a capacitive sensor.

In yet another example embodiment, a method for dispensing is provided. The method comprises determining whether a first sensor is in a reliable state or an unreliable state. The method further includes, in response to determining that the first sensor is in the reliable state, initiating a dispensing mechanism to dispense a portion of a fluid based on sensing an object by the first sensor and not a second sensor. The method further includes, in response to determining that the first sensor is in the unreliable state, initiating the dispensing mechanism to dispense the portion of the fluid based on sensing the object by the second sensor and not the first sensor, wherein the first sensor and the second sensor are different.

In some embodiments, the first sensor is one of an infrared sensor, a time-of-flight sensor, a break beam sensor, an optical sensor, a capacitive sensor, an ultrasonic sensor, a radar sensor, a LiDAR sensor, an image sensor, a passive infrared sensor, or a camera.

In some embodiments, in response to determining that the first sensor is in the unreliable state, the method further comprises: detecting a change within a sensing field of the second sensor, wherein the change indicates the object is within the sensing field; and causing, in response to sensing the object within the sensing field, the dispensing mechanism to operate to dispense the portion of the fluid. In some embodiments, the second sensor is positioned proximate the outlet. In some embodiments, the second sensor is a capacitive sensor.

In yet another example embodiment, a dispenser is provided. The dispenser comprises a reservoir configured to house a fluid and a dispensing mechanism configured to dispense a portion of the fluid from the reservoir through an outlet. The dispenser further includes a first sensor configured to sense a presence of an object; a second sensor positioned proximate the outlet and configured to sense the presence of the object, wherein the second sensor is a type of sensor that is different than the first sensor; and a controller. The controller is configured to operate according to a first state by using the first sensor to determine whether to initiate a dispense of the portion of the fluid. The controller is further configured to operate according to a second state by using the second sensor to determine whether to initiate a dispense of the portion of the fluid. The controller is further configured to determine that the first sensor is in an unreliable state and cause operation according to the second state.

In some embodiments, the first sensor is one of an infrared sensor, a time-of-flight sensor, a break beam sensor, an optical sensor, a capacitive sensor, an ultrasonic sensor, a radar sensor, a LiDAR sensor, an image sensor, a passive infrared sensor, or a camera. In some embodiments, the second sensor is a capacitive sensor. In some embodiments, the second sensor is positioned partially around the outlet.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
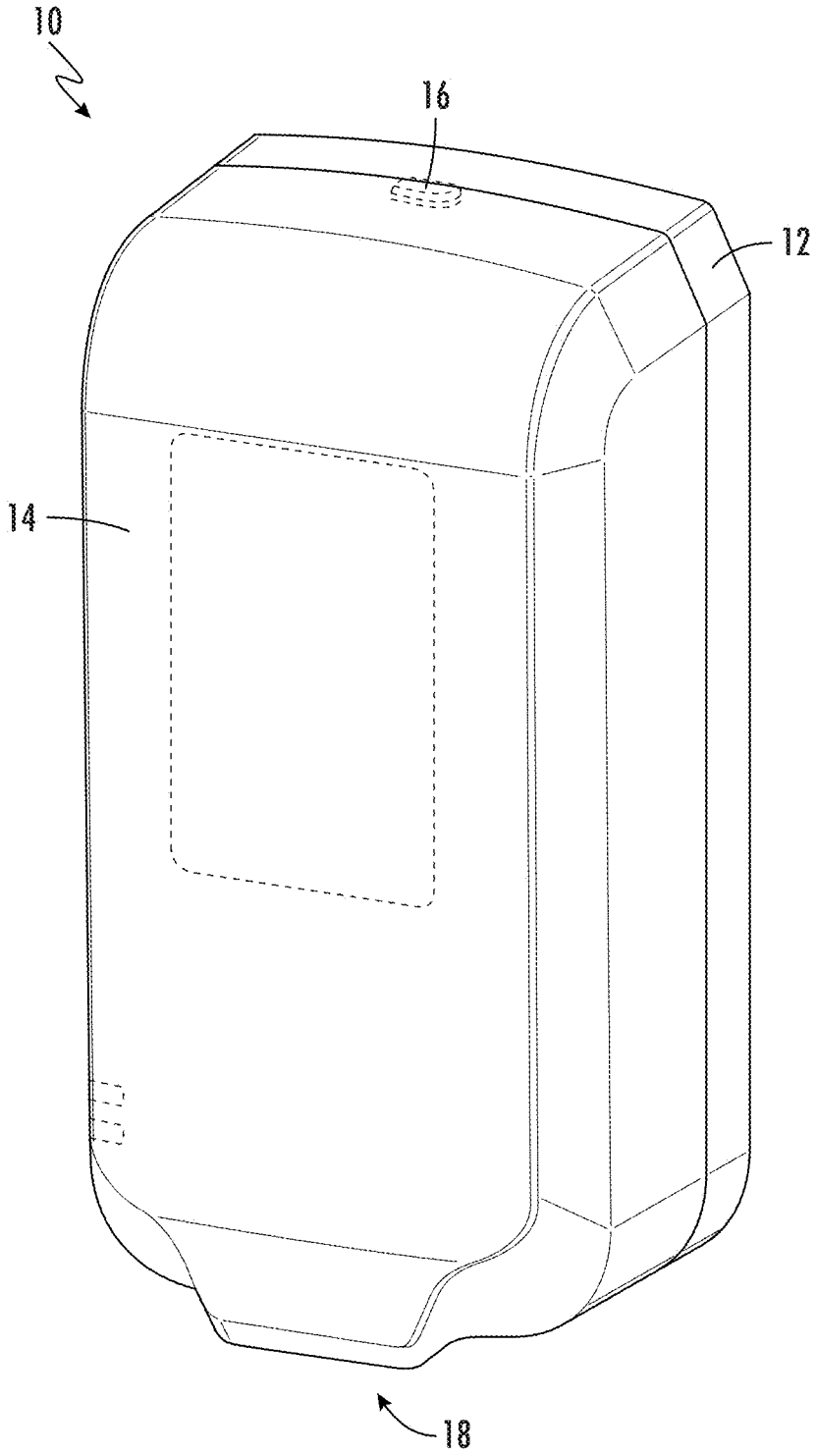
FIG. 1 shows a perspective view of an example fluid dispenser, in accordance with some example embodiments described herein.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Certain terms are used throughout the following description and claims to refer to particular features or components. As one skilled in the art will appreciate, different persons may refer to the same feature or component by different names.

Example embodiments of the present invention provide fluid dispensers and fluid dispenser assemblies that may deliver a product, such as soap, hand sanitizer, and/or other fluids, liquids, or foams to a user. The skincare product may be used, for example, for hand washing and/or sanitizing. In general, a fluid, as referred to herein, may be a substance that has no fixed shape and yields easily to external pressure. For example, a fluid may be a substance that flows easily. Some non-limiting examples of fluids are liquid soap hand sanitizer, which may be dispensed as a liquid or converted to a foam by a foaming pump prior to dispensing.

Figure 14:
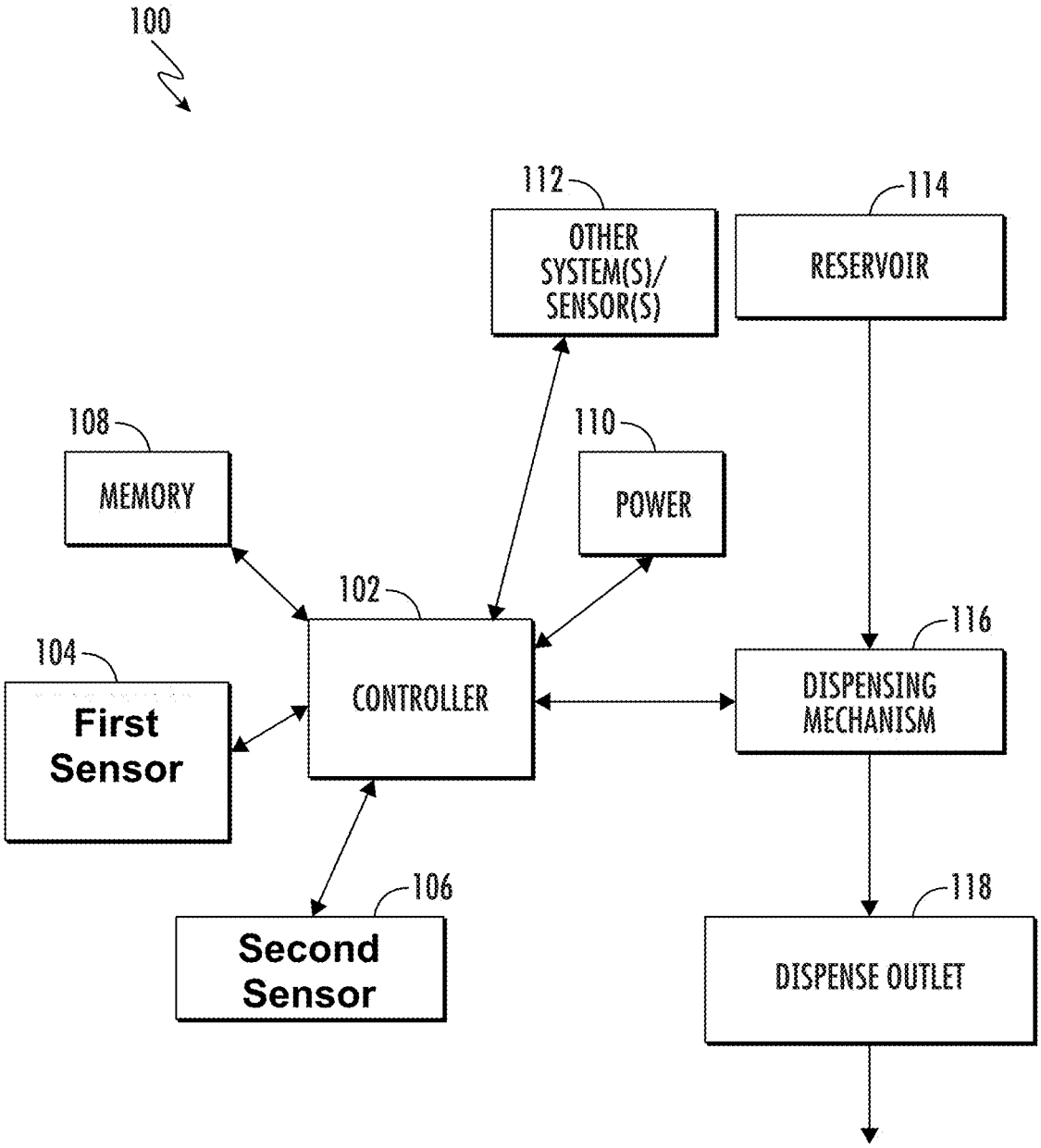
FIG. 14 shows a block diagram of an example fluid dispenser, in accordance with some embodiments discussed herein.

Such example embodiments may utilize any type of dispenser housing/configuration with the components and features necessary to provide the dispensed portion of fluid product (e.g., a dose) to the end user. For example, FIG. 14 provides an example block diagram of an example fluid dispenser 100 and its corresponding components/features. Notably, such example components/features (including others described herein) may be utilized with any type of dispenser housing/configuration, such as a wall mounted dispenser, a counter mounted dispenser, a stand-alone dispenser, an under-cabinet mounted dispenser, among many others.

FIG. 1 illustrates an example fluid dispenser 10 with a housing formed of a back portion 12 and cover 14. A user, such as a maintainer or maintenance person, may open the cover 14, such as by inserting a key or pressing a button (e.g., with respect to a latch 16). In general, the dispenser housing encloses the fluid reservoir such that only approved individuals may access the interior of the dispenser (including the fluid reservoir). For example, the cover 14 may form a hinged door or removable panel that may be secured to prevent unauthorized access to the interior of the dispenser. The cover 14 may be secured in a closed position with a key or other locking mechanism.

Notably, the fluid dispenser 10 is an automated fluid dispenser that includes two activation sensors. For example, as described herein, the fluid dispenser 10 comprises two different activation sensors, where a user may interact with each activation sensor to activate the fluid dispenser 10 to cause occurrence of a dispense. For example, the user (e.g., consumer) may place his or her hand in the vicinity of an object detector (e.g., within dispensing area 18) to cause the fluid dispenser 10 to provide fluid or foam to the user. When the fluid dispenser 10 is activated (e.g., when a sensor detects a user's hand), a dispensing mechanism (e.g., gears, motor, etc.) within the fluid dispenser 10 causes the fluid dispenser 10 to activate and dispense fluid from the reservoir 24. Thereafter, the dispensed portion of fluid may drip or fall from underneath the fluid dispenser 10 (such as within dispensing area 18).

Figure 2:
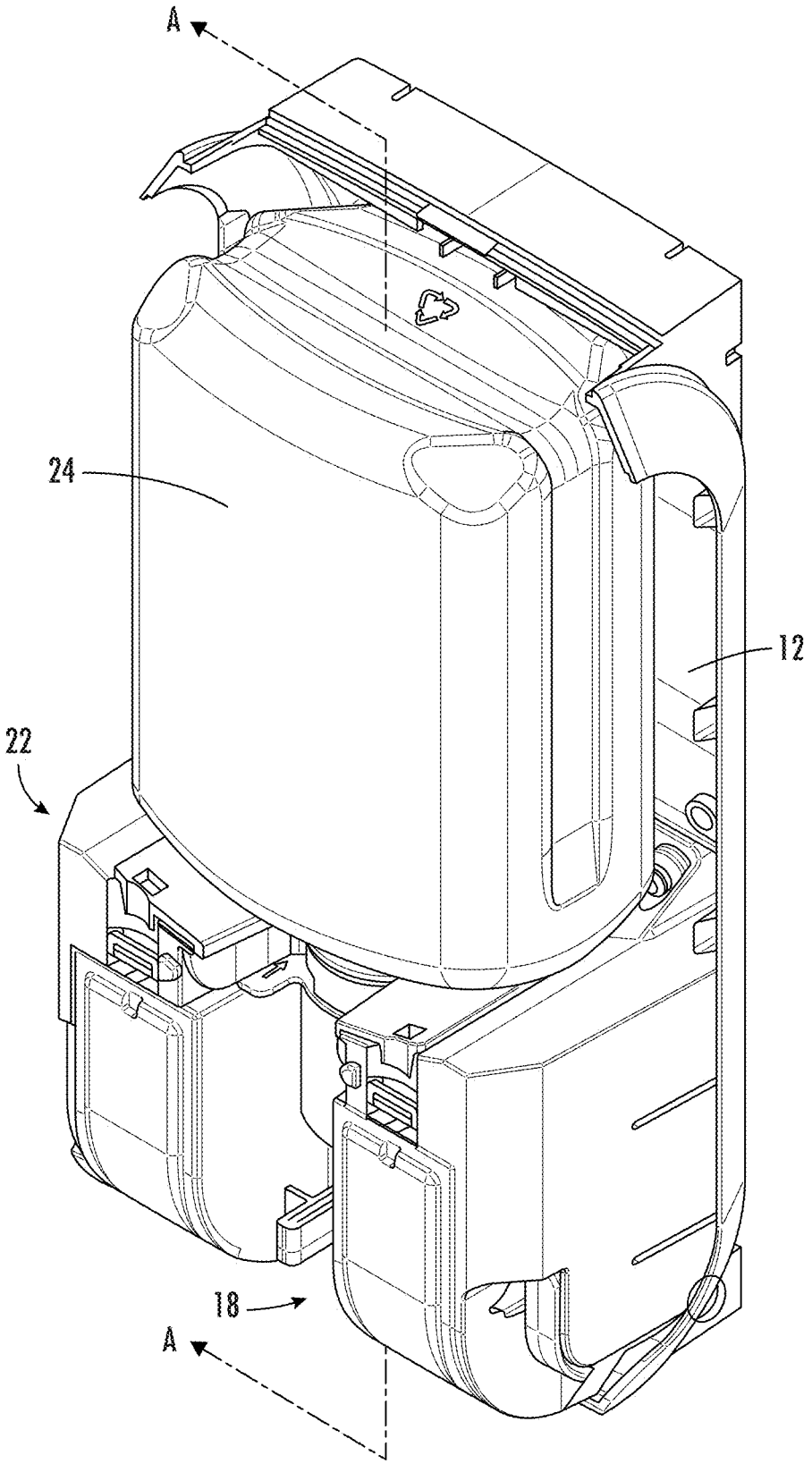
FIG. 2 shows a perspective view of an example fluid dispenser with a cover removed, in accordance with some example embodiments described herein.
Figure 3:
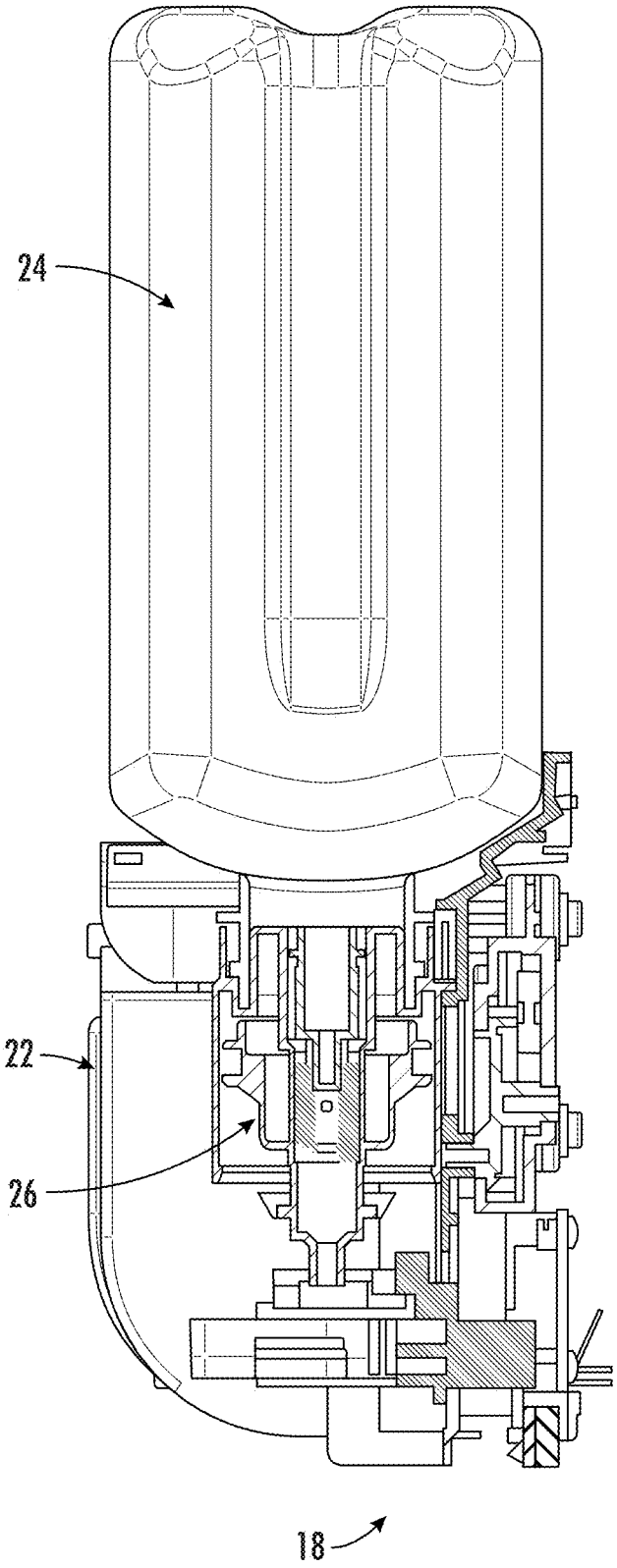
FIG. 3 shows a side section view taken along line A-A in FIG. 2, in accordance with some example embodiments described herein.

With reference to FIGS. 2-3, the fluid dispenser 10 may include a dispensing mechanism comprising a drive assembly 22 that is configured to interact with fluid reservoir 24 and nozzle assembly 26. The nozzle assembly 26 (e.g., pump) is configured to receive fluid from the fluid reservoir 24 and provide fluid or foam to the user. The drive assembly 22 may be positioned within the dispenser housing, such as attached to the back portion 12. Though not shown, the drive assembly 22 may include one or more components (e.g., a motor, gears, etc.) that enable operation of a pump of the nozzle assembly 26 to cause dispensing of a portion of the fluid from the reservoir 24. In the illustrated embodiment, the reservoir 24 is a collapsible bottle, but in other embodiments the reservoir 24 may be any other reservoir, such as a bag.

Though the above described and shown fluid dispenser 10 is an automated, wall mounted soap dispenser, embodiments of the present invention are contemplated for use with other types of dispensers. For example, the fluid dispenser 10 may be an under-counter mounted fluid dispenser.

As detailed herein, the fluid dispenser 10 includes two activation sensors, a first sensor 28 and a second sensor 30. Notably, the two activation sensors, in some embodiments, are different types of sensors from each other—which helps in enabling dispense ability of the fluid dispenser 10 regardless of the environment conditions (e.g., lighting, humidity, smoke, etc.). Example types of automated activation sensors, which may be used as either the first sensor or the second sensor, include infrared, time-of-flight, break beam, optical, capacitive, ultrasonic, radar, LiDAR (Light Detection And Range), image, passive infrared (PIR), camera, among others. In some embodiments, the first sensor 28 may be a type of proximity sensor which detects that an object is within the sensing area, and the second sensor 30 may be an object detector to determine the object is within the sensing area. Alternatively, the first sensor 28 may be an object detector, configured to detect the presence of the object, and the second sensor 30 may be a proximity sensor to determine the proximity of the object to the fluid dispenser 10.

Figure 9:
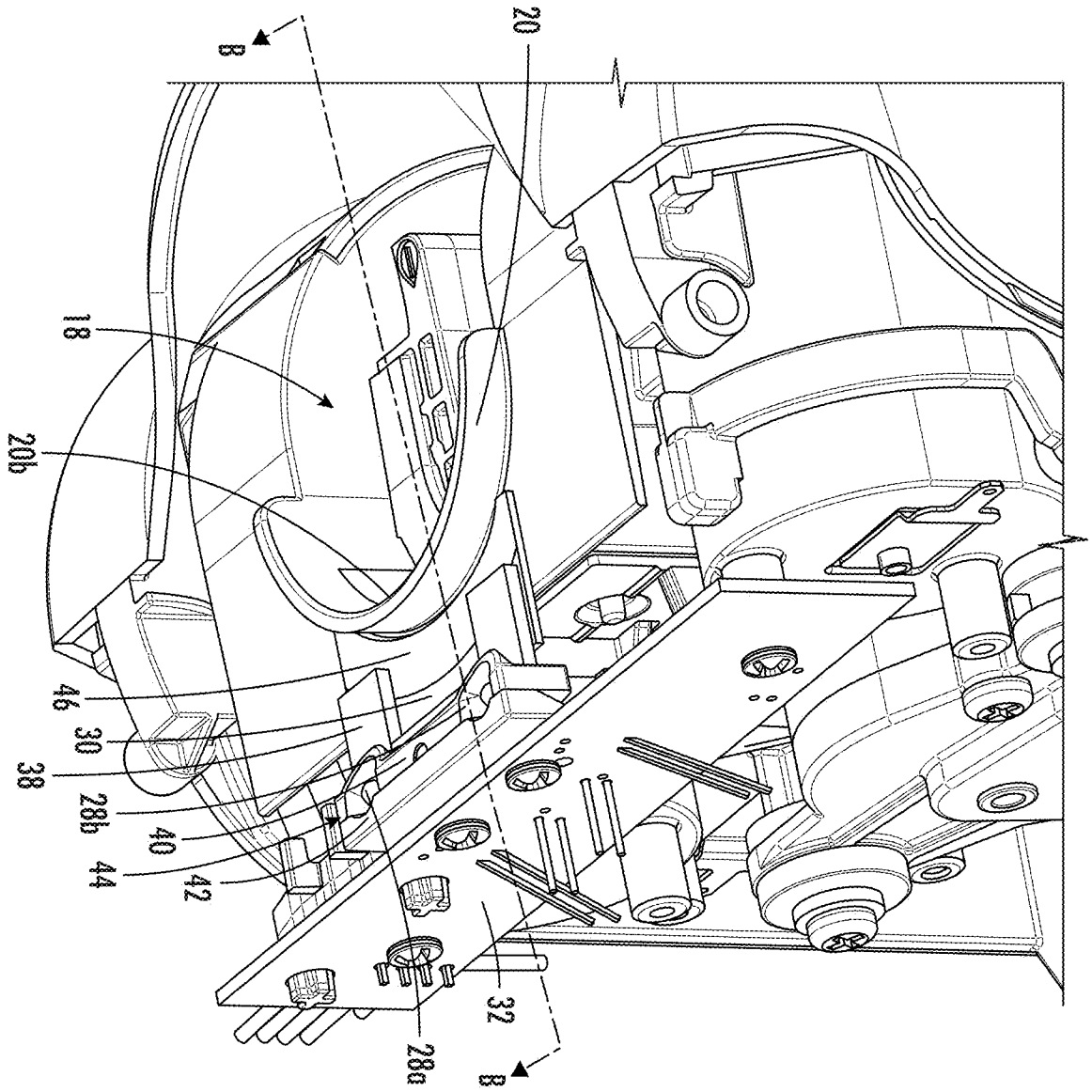
FIG. 9 shows a close-up bottom view of part of an example fluid dispenser, in accordance with some example embodiments described herein.

With reference to FIG. 9, the fluid dispenser 10 includes two activations sensors. In some embodiments, the first activation sensor 28 (28*a*, 28*b*) may be an infrared sensor and the secondary activation sensor 30 may be a capacitive sensor. In some embodiments, the first sensor 28 and the second sensor 30 may be positioned proximate an outlet 20 of the fluid dispenser 10, as depicted in FIG. 9. For example, the first sensor 28 may be positioned behind the outlet 20 (e.g., closer to the back portion 12 than to the cover 14), and the second sensor 30 may be positioned partially around and/or adjacent to the outlet 20. In other embodiments, one or both of the first sensor 28 and the second sensor 30 may be positioned anywhere else on or near the fluid dispenser 10. A controller of the fluid dispenser 10 may be configured to switch between the first sensor 28 and the second sensor 30 depending on environmental conditions that lend themselves to beneficial usage of one sensor over the other. For example, the fluid dispenser 10 (e.g., via a controller) may switch between using the first sensor 28 or the second sensor 30 for determining whether to cause a dispense based on a detected level of ambient light. In some embodiments, the threshold level of ambient light may correlate to when the sensing circuit of the first sensor 28 is saturated, as discussed in more detail herein.

The first sensor 28 may be configured to sense a presence of an object, such as a human hand, by receiving a first type of input, which may correspond to the type of sensor being used. In this regard, the first type of input may be receipt of a signal pulse, wherein the signal is one of light, sound, electromagnetic wave, radio wave, or similar, a change in sensing field (e.g., voltage, optical, capacitance, etc.) or other types of inputs. In an example embodiment, when the first sensor 28 is an infrared sensor the first type of input may comprise receipt of one or more signal pulses reflected off of an object, such as a human hand, placed within an area in which infrared pulses are emitted. The first sensor 28 may comprise a transmitter 28*a* and a receiver 28*b*. The transmitter 28*a* may be configured to transmit one or more pulses outwardly, such as toward the dispensing area 18. Reflections of the pulses (e.g., pulse receipts) may reflect off an object, such as human hand, and be received (e.g., detected) by the receiver 28*b* to indicate the presence of the object (e.g., if no reflection occurs, because there is no object present in the dispensing area 18, then no reflection should be received by the receiver 28*b*—thereby indicating that no dispense is needed). If the receiver 28*b* receives a reflection, the controller may determine that a dispense is desired and subsequently cause the dispensing mechanism to initiate a dispense, such as by causing the drive assembly 22 and the nozzle assembly 26 to dispense a portion of fluid from the reservoir 24.

The second sensor 30 may also be configured to sense a presence of an object, such as a human hand, by receiving a second type of input. The second type of input may be different than the first type of input detected by the first sensor 28. In an example, the second sensor 30 may be a capacitive sensor, and the second type of input received may comprise a detection of a change within the sensing field, specifically a change in capacitance within a capacitive sensing field due to the presence of an object, such as a human hand, placed therein. As will be described in greater detail herein, a capacitive sensor, or similar may form a sensing field (e.g., an electrostatic field) that is disrupted when an object, such as a user's hand, is positioned therein. In this regard, when the second sensor 30 is configured as a capacitive sensor, the second sensor 30 may include one or more antennas that are configured to sense the capacitance level within the sensing field and, when the capacitance level changes to indicate presence of an object, the controller may determine that a dispense is desired and subsequently cause the dispensing mechanism to initiate a dispense.

In some embodiments, the first sensor 28 may be the primary activation sensor relied upon by the controller of the fluid dispenser 10 to determine whether to cause a dispense based on the first type of input. In some embodiments, the first sensor 28 may act as the default activation sensor until an adverse environmental condition is detected, such as to cause the controller to switch to use of the second sensor 30. In this regard, the first sensor may be determined to be in a reliable state when there is a lack of adverse environmental conditions (e.g., certain conditions are present) and to be in an unreliable state in adverse environmental conditions.

When using the first sensor 28, in some embodiments, the controller of the fluid dispenser 10 may be configured to determine whether the environmental conditions present dictate a need to switch to using the second sensor 30 (e.g., a capacitive sensor)—e.g., the first sensor becomes unreliable in accurately determining whether to cause a dispense. For example, the controller may be configured to determine whether the first sensor 28 is in an unreliable state, due to the current environmental conditions. In this regard, certain environmental conditions may prevent the first sensor from accurately detecting the presence of an object, such as due to, for example, the first sensor being partially or fully saturated with ambient light, having lost power, or being otherwise unable to perform a desired sensing operation. In this regard, when the first sensor 28 is in the unreliable state, reflection of the pulse off the object (e.g., user's hand) may not register as a significant enough of a change to indicate that the object is present so as to cause a dispense to occur.

Accordingly, using the first sensor 28 in such a scenario to determine whether to initiate a dispense may be frustrating to a user—as no dispense may occur even though the user is positioning the object (e.g., their hand(s)) properly within the dispensing area 18. As used herein, it should be understood that the term "environmental condition" refers to one or more external factors or circumstances surrounding the fluid dispenser 10.

The controller may be configured to determine when the first sensor 28 is in a reliable state or an unreliable state. In this regard, the controller may receive data from the first sensor 28 which contains an indication of an adverse environmental condition, or an indication of a lack of an adverse environmental condition. In response to receiving an indication of an adverse environmental condition, the controller may determine the first sensor 28 is in an unreliable state, and rely on the second sensor 30 to detect the presence of an object. Alternatively, in response to receiving an indication of a lack of an adverse environmental condition, the dispensing mechanism may operate to dispense a portion of the fluid due to the first sensor 28 detecting the object.

In an example embodiment, the adverse environmental condition may be an ambient light level in the environment surrounding the fluid dispenser. In this regard, the controller may cause the receiver 28*b* of the first sensor 28 to detect a light level (e.g., register receipt of light therein) so as to determine, for example, if the first sensor 28 is in the unreliable state. In some embodiments, the detected light level may be used to determine if the first sensor 28 is in the unreliable state. For example, the controller may be configured to determine that the first sensor 28 is sufficiently saturated with ambient light when ambient light causes the voltage within the circuit to change to a level significant enough to cause making a determination of a pulse either difficult or impossible. For example, the constant saturation of the light may cause a corresponding constant voltage reading that makes it difficult to sense a meaningful voltage difference that would otherwise be noticeable (e.g., the meaningful voltage difference would normally be noticeable and attributed to the object reflecting a pulse (e.g., indicating a request for a dispense to occur)).

After causing the actuation of the receiver 28*b* of the first sensor 28, the controller may be configured to determine whether the first sensor 28 is in a reliable state by measuring a voltage level within a circuit of the first sensor 28. If the measured voltage level does not satisfy a predetermined threshold, the controller may be configured to switch from a first state to a second state. In some embodiments, the first state may be a state of operation in which the fluid dispenser 10 uses the first sensor 28 to determine whether to initiate a dispense of a portion of the fluid in the reservoir 24 based on the first type of input. The second state may be a state of operation in which the fluid dispenser 10 uses the second sensor 30 to determine whether to initiate a dispense of a portion of the fluid in the reservoir 24 based on the second type of input. Moreover, the controller of the fluid dispenser 10 may be configured to switch between the first state and the second state depending on whether the first sensor 28 is determined to be in the reliable state or in the unreliable state.

In some embodiments, the controller may be configured to cause the first sensor 28 to receive power before the controller determines the state of the first sensor 28. Further, in instances in which the first sensor 28 is determined to be in the unreliable state, the controller may be configured to cause the second sensor 30 to receive power. In some embodiments, the controller may continue to provide power to both the first sensor 28 and the second sensor 30 until a determination is made that the first sensor 28 has returned to the reliable state. In instances in which the controller has determined that the first sensor 28 returned to the reliable state, the controller may be configured to cease power from being supplied to the second sensor 30. The selective power to the second sensor 30 may provide potential power savings, thereby extending the battery life thereof and/or reducing the operating cost. Alternatively, in other embodiments, the controller may be configured to continuously provide power to both the first sensor 28 and the second sensor 30.

As discussed, different types of sensors may have varying performances in different environmental conditions. For example, some sensors may underperform in extreme temperature, high humidity, when exposed to pollution (e.g., dust or particles), due to electromagnetic interference, light saturation, etc. In this regard, the first sensor 28 and/or the second sensor 30 may be selected such that when the first sensor is in the unreliable state due to adverse environmental conditions, the second sensor 30 is in a reliable state or at least not likely in an unreliable state due to the same adverse environmental conditions.

For example, infrared sensing may be a preferred method of sensing in environments that are not saturated with ambient light. However, in environments that are saturated with ambient light, an infrared sensor may be inoperable and/or inaccurate (e.g., because pulse receipts cannot be detected accurately). In such environments, a different method of sensing, such as capacitive sensing, may be preferred. Instead of detecting infrared pulse receipts, capacitance across the capacitive sensor may change depending on the dielectric constant of materials positioned within an electrostatic field. Without being bound by theory, air has a relatively low dielectric constant as compared to the dielectric constant of an object, for example a human hand. As such, when an object, such as a human hand, is positioned within the electrostatic field of the capacitive sensor, the capacitive sensor may detect a capacitance that is different than when an object is not positioned within the electrostatic field (e.g., when air is positioned within the electrostatic field). By detecting when an object is positioned within the electrostatic field, the capacitive sensor may determine when the fluid within the reservoir 24 of the fluid dispenser 10 should be dispensed.

Notably, while the above example focuses on light saturation of an infrared sensor as being an example of an adverse environmental condition which causes the unreliable state, various embodiments of the present invention contemplate other conditions that cause unreliability of the sensor(s)—which may be determined and which may call for a switch to usage of the second sensor. Some example other conditions include power failure, maintenance issue(s), blockage of the sensor, among other conditions.

Figure 4:
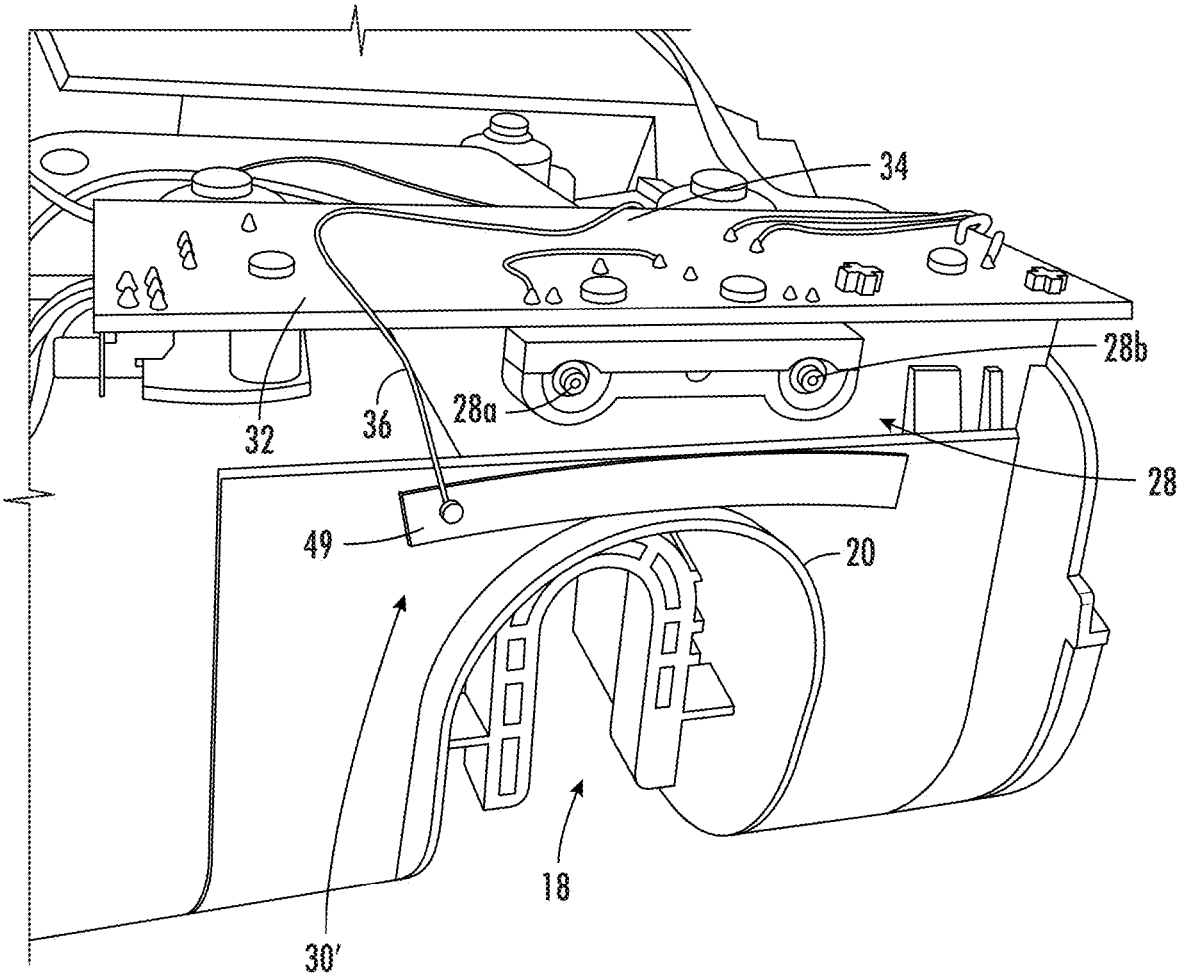
FIG. 4 shows a bottom view of part of an example fluid dispenser assembly, in accordance with some example embodiments described herein.
Figure 11:
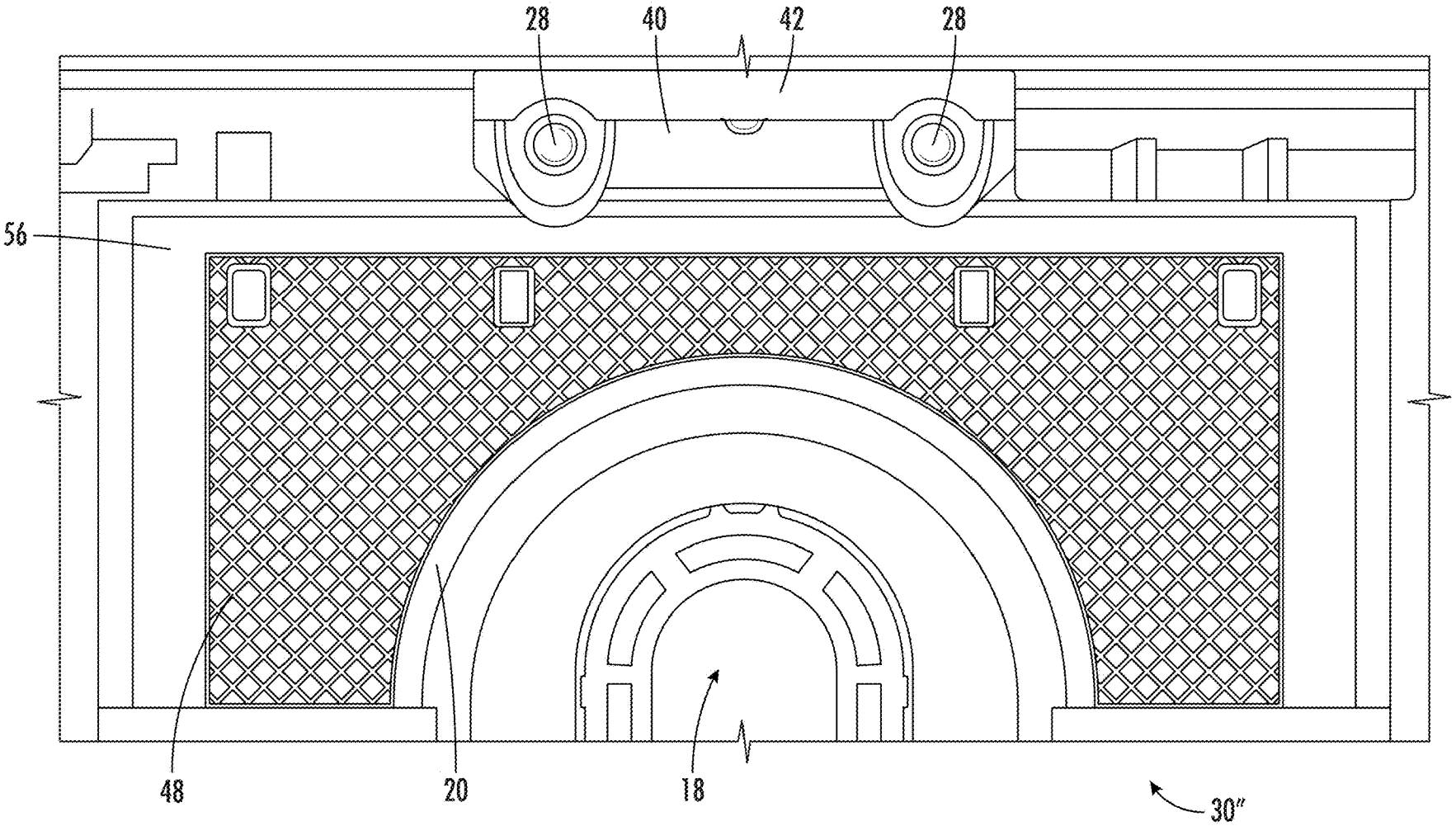
FIG. 11 shows a bottom view of an example infrared sensor and an example antenna for a capacitive sensor that are installed in an example fluid dispenser, in accordance with some example embodiments described herein.
Figure 12:
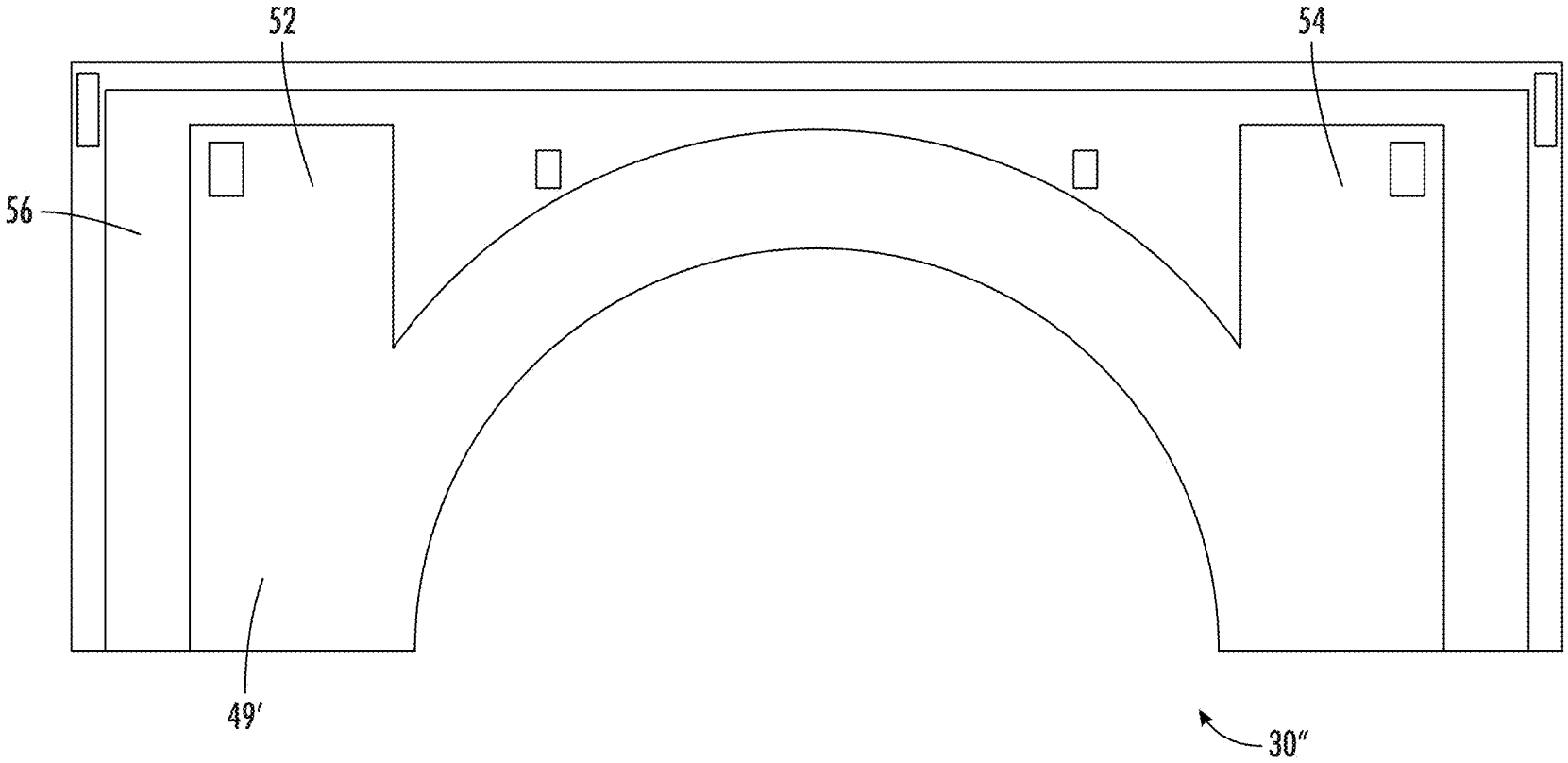
FIG. 12 shows a bottom view of an example antenna, in accordance with some example embodiments described herein.
Figure 13:
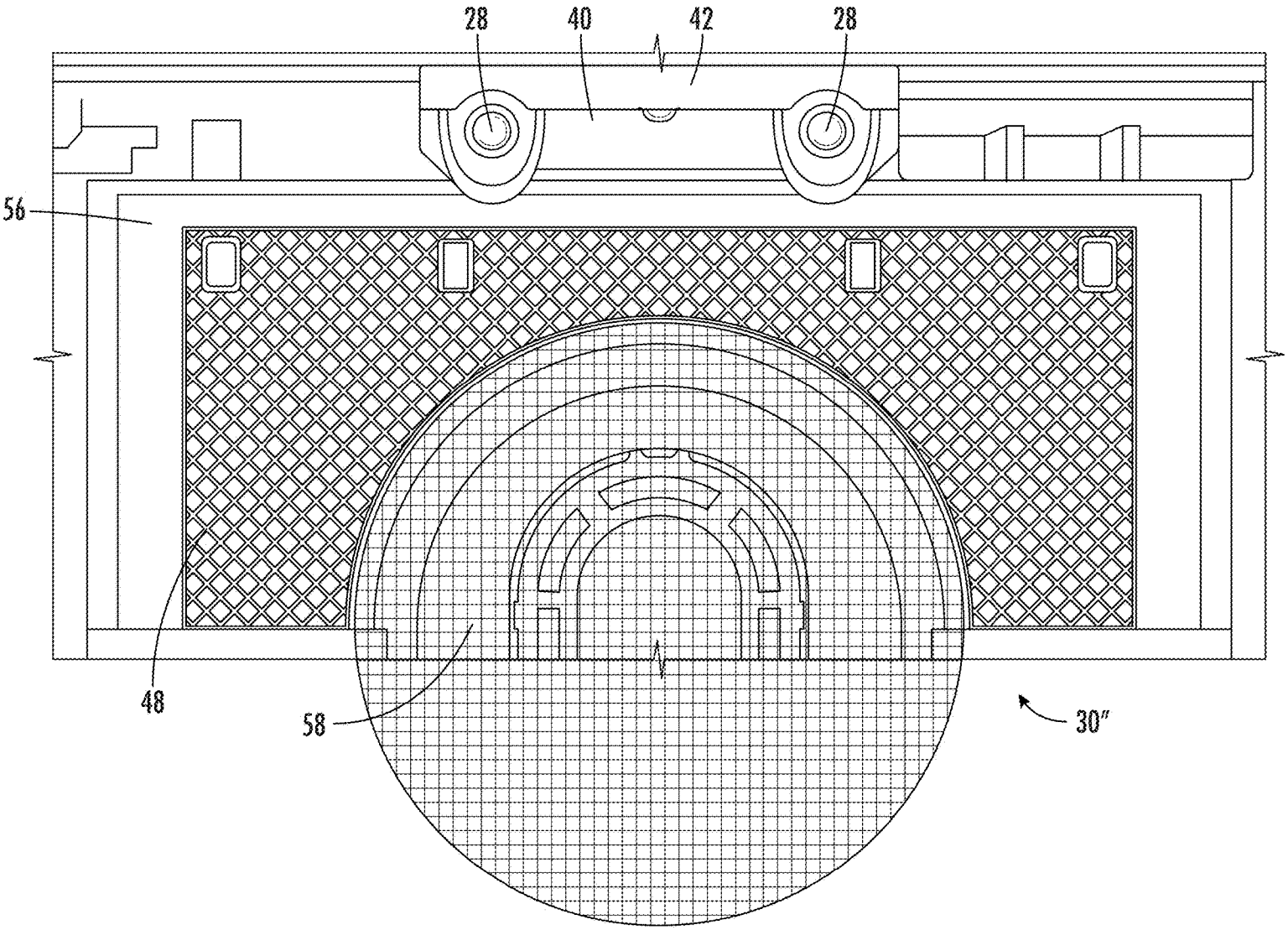
FIG. 13 shows a bottom view of the example infrared sensor and capacitive sensor shown in FIG. 11, illustrating an example capacitance sense field, in accordance with some example embodiments described herein.

FIG. 4 illustrates an example second sensor 30' connected to a circuit board 32. In the illustrated embodiment, the second sensor 30' is configured as a capacitive sensor, and is connected to a circuitry on the circuit board 32 at a connection point 34 by an antenna wire 36. The illustrated second sensor 30' includes an antenna 49 that is configured to focus a sensing field (e.g., capacitance field) within the dispensing area 18 underneath the outlet 20. Notably, the antenna may take any shape and may result in a correspondingly shaped capacitance sense field. For example, the second sensor 30 illustrated in FIGS. 5-10 includes an antenna 46 that forms a partial circular band that is designed to wrap around the outlet 20 to form a sensing field within the dispensing area 18. As another example, FIGS. 11 and 13 illustrate another second sensor 30" with an antenna 48 that forms a rectangular shape with a circular portion removed corresponding to the shape of the outlet 20 to form a sensing field within the dispensing area 18. FIG. 12 illustrates another shaped antenna 49' (e.g., with fingers 52, 54) for a second sensor 30'", which forms another sensing field within the dispensing area 18. In some embodiments, a more focused sensing field can help minimize sensor influence outside of the target object being sensed. Alternatively, physical abutments may create a shield about the antenna, for example, as shown in FIGS. 11-12 the antenna may be connected to a ground shield 56.

In some embodiments, the second sensor 30 may include more than one antenna. For example, multiple antennas may be provided. In some embodiments, two or more of the multiple antennas may be tuned to different frequencies. In some embodiments, two or more of the multiple antennas may be interleaved onto the same plate of the second sensor 30, and in other embodiments, the multiple antennas may be parallel or in any other configuration. In some embodiments, the antennas may be configured to work independently or as a single unit. For example, in some embodiments, a summation of antennas may be performed using a processor, while in other embodiments, a summation may be achieved through a hardware configuration. The multiple antennas may help prevent noise sensitivity of the second sensor 30. For example, a capacitive sensor with multiple antennas may have sensitivity to multiple frequencies such that it can block out inaccurate frequencies if presented by the environment.

Figure 5:
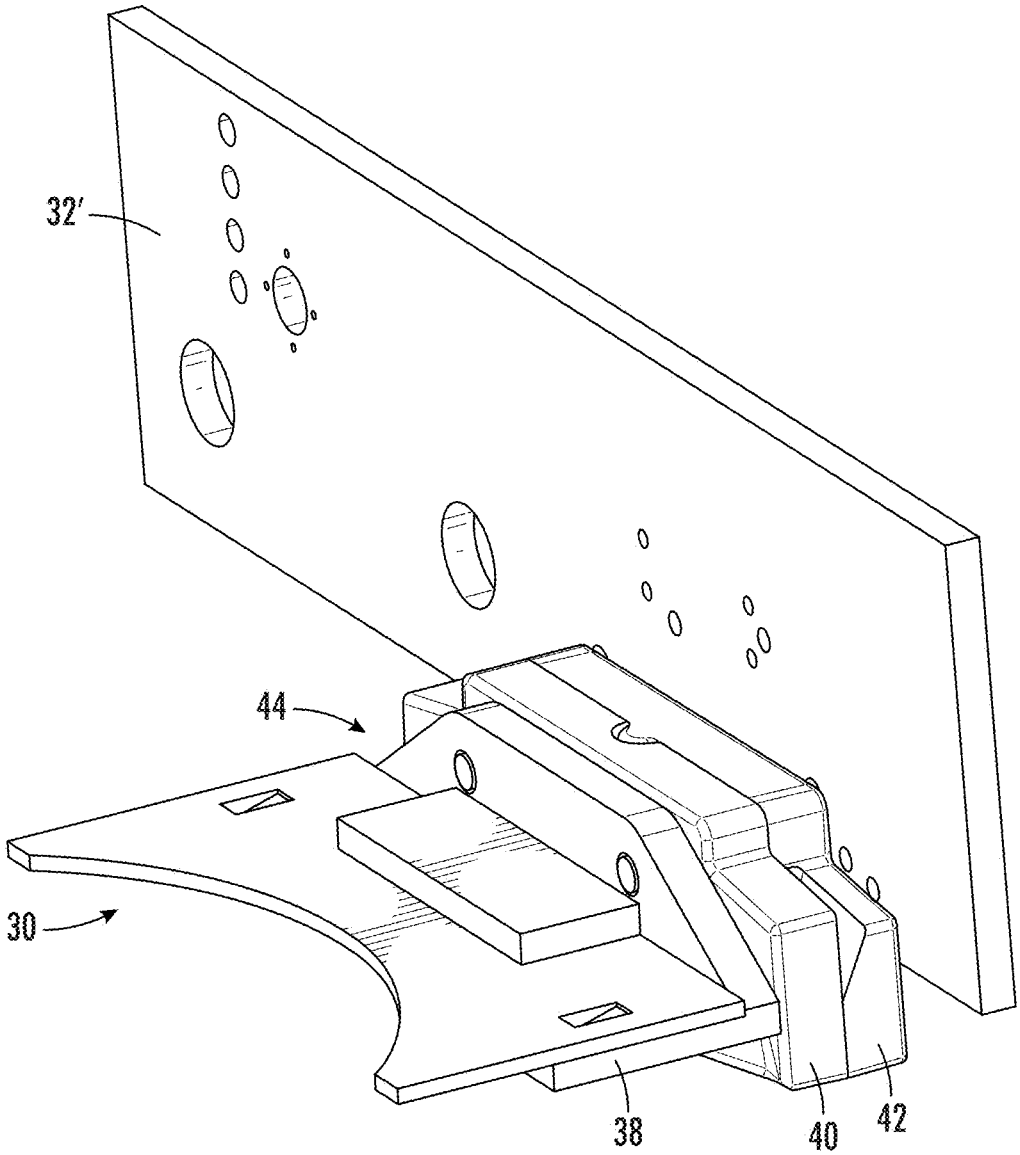
FIG. 5 shows a perspective view of an example sensor mounting assembly, in accordance with some example embodiments described herein.
Figure 6:
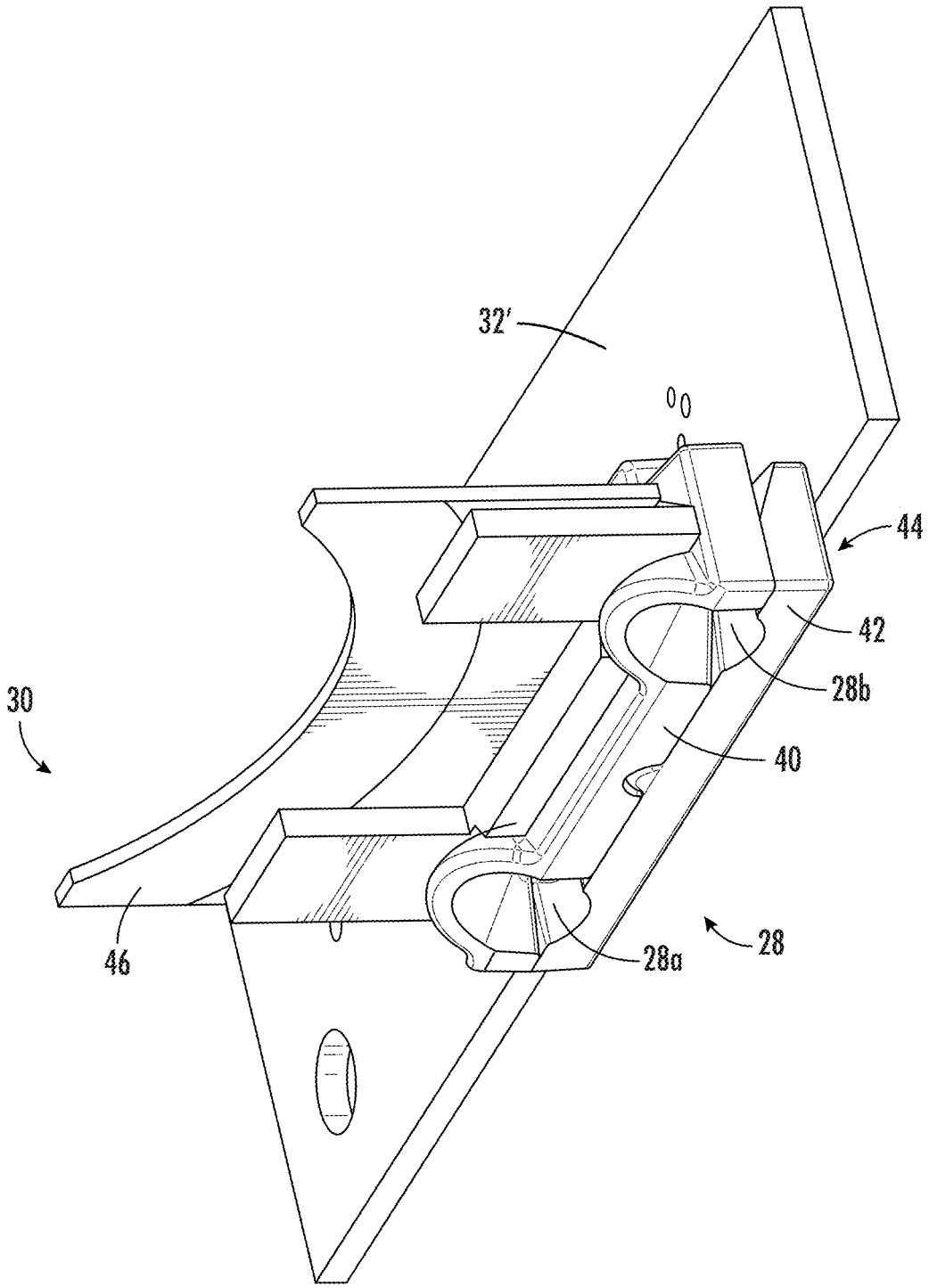
FIG. 6 shows a bottom view of the example sensor mounting assembly shown in FIG. 5, in accordance with some example embodiments described herein.
Figure 7A:
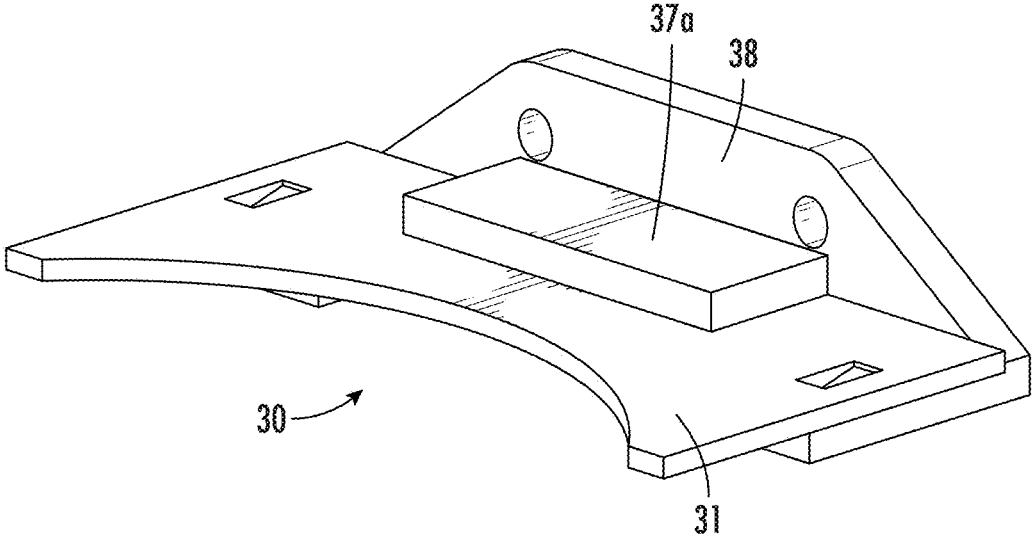
FIG. 7A shows a perspective view of an example capacitive sensor and an example bracket, in accordance with some example embodiments described herein.
Figure 7B:
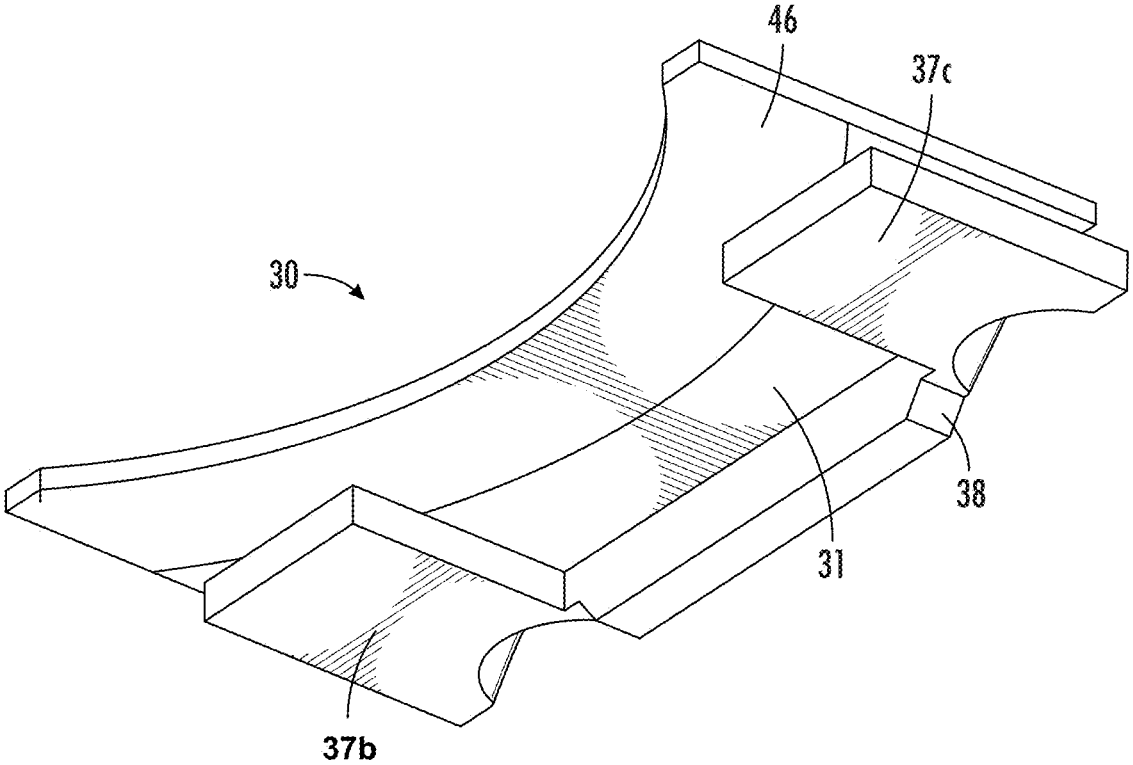
FIG. 7B shows a bottom view of the example capacitive sensor and bracket shown in FIG. 7A, in accordance with some example embodiments described herein.

Referring now to FIGS. 5-7B, the second sensor 30 may be mounted to the fluid dispenser 10 using a bracket 38. In this regard, with reference to FIGS. 7A-7B, the second sensor 30 may be formed of an antenna 46 mounted to a ground plate 31. The ground plate 31 may be fitted, (e.g., fastened, interference fitted, adhered, etc.), between mounting arms 37*a*, 37*b*, and 37*c* of the bracket 38. The bracket 38 may be part of a sensor mounting assembly 44, as depicted in FIG. 5. The sensor mounting assembly 44 may include a first sensor bracket 40 and a second sensor bracket 42, along with the bracket 38. The sensor mounting assembly 44 may be configured to receive and secure the second sensor 30 and the first sensor 28. For example, the first sensor bracket 40 and the second sensor bracket 42 may be configured to surround and house the first sensor 28 such that the first sensor 28 can be mounted to the fluid dispenser 10 with sensor mounting assembly 44. With reference to FIG. 6, the transmitter 28*a* and the receiver 28*b* of the first sensor 28 may be mounted on the circuit board 32' and aimed to emit pulses to and receive pulse receipts from, respectively, the dispensing area. The sensor mounting assembly 44 also may be configured to position the first sensor 28 and the second sensor 30 such that each may be connected to control circuitry on a circuit board 32'.

In some embodiments, the second sensor 30 may be a single plate capacitive sensor comprising one or more antennas. The second sensor 30 may be, in some embodiments, formed from a copper plate or plate assembly, a printed circuit board, or other suitable material, and may be formed of a solid material, a lattice or mesh construction, or any other suitable construction. For example, in the embodiment shown in FIG. 6, the second sensor 30 includes an antenna 46 formed of a copper plate. However, in other embodiments, the second sensor 30 may be any other type of antenna-based sensor.

Figure 8:
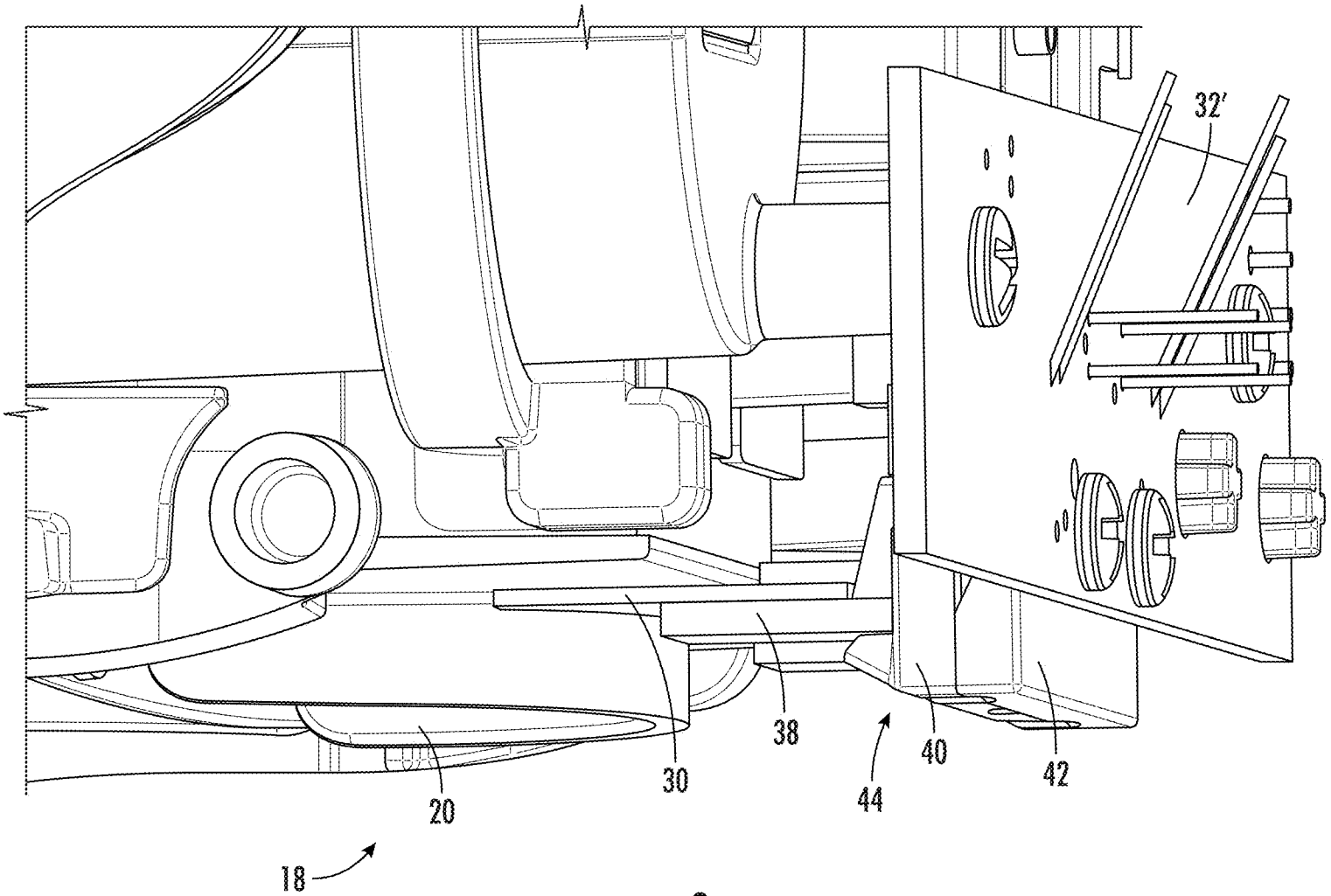
FIG. 8 shows a close-up side view of part of an example fluid dispenser, illustrating an example position of the capacitive sensor and bracket, in accordance with some example embodiments described herein.
Figure 10:
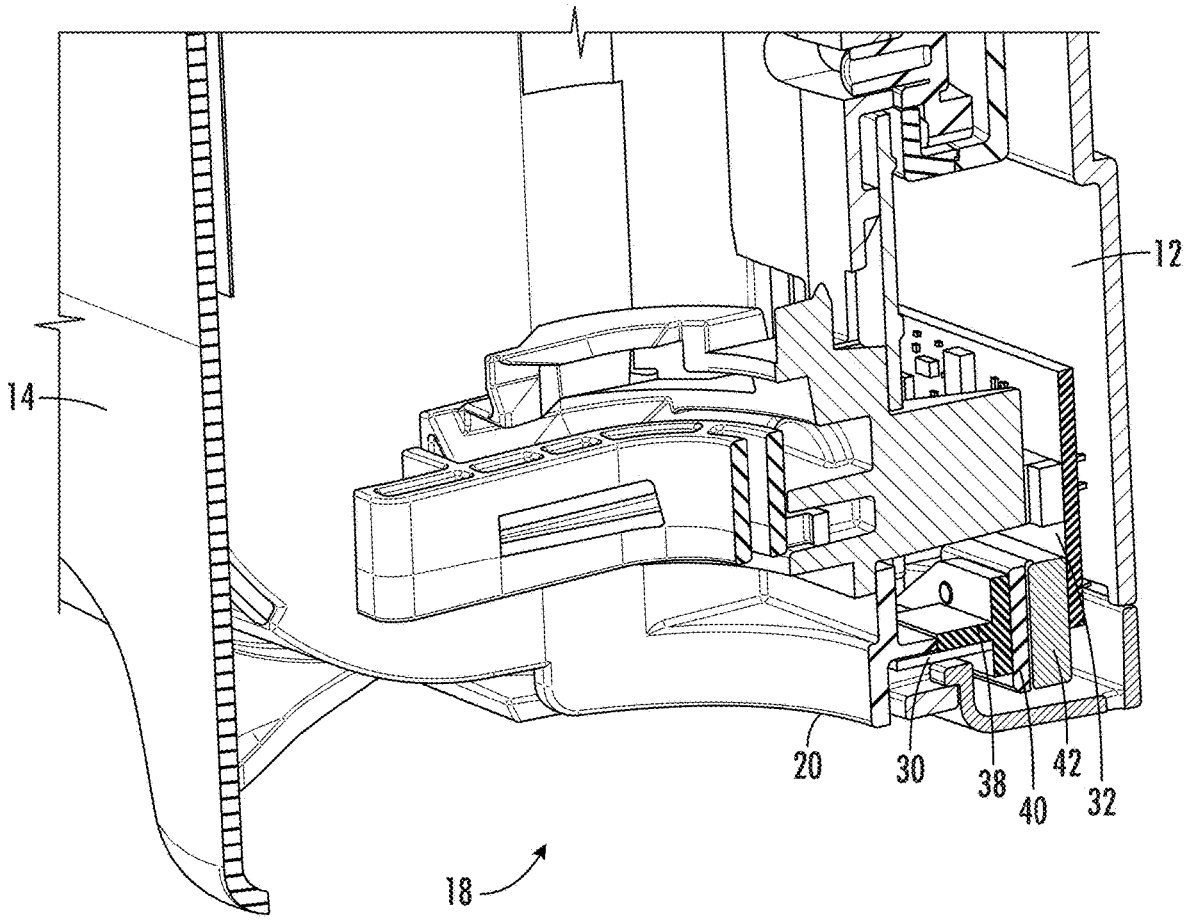
FIG. 10 is a cross-sectional view of the example fluid dispenser in FIG. 9 taken along line B-B, in accordance with some example embodiments described herein.

Referring now to FIGS. 8-10, the circuit board 32' and the sensor mounting assembly 44 may be installed within the fluid dispenser 10 in the manner shown, such that the first sensor 28 and the second sensor 30 may be positioned proximate the outlet 20 of the fluid dispenser 10. For example, the circuit board 32' may be mounted near the first sensor 28 and the second sensor 30 such that wires, such as the antenna wire 36, may be connected from the first sensor 28 and the second sensor 30 to the circuit board 32'. Further, in some embodiments, the circuit board 32' may be installed such that it is within the fluid dispenser 10, e.g., between the cover 14 and the back portion 12. This may be useful to protect the control circuitry (e.g., controller) and other internal elements of the fluid dispenser 10 from, e.g., weather. In other embodiments, the circuit board 32' and the sensor mounting assembly 44 may be installed in any other way, and the first sensor 28 and the second sensor 30 may be positioned in any other configuration.

Referring specifically to FIG. 9, the first sensor 28 and the second sensor 30 may be positioned such that optimal results can be obtained when a user places his or her hand within the dispensing area 18. For example, the second sensor 30, which may have a smaller sensing range than the first sensor 28, may be positioned partially around the outlet 20. In some embodiments, the second sensor 30 may be positioned closer to the outlet 20 than the first sensor 28. Further, in some embodiments, the second sensor 30 may be positioned such that a typical placement of a user's hand will result in the user's fingertips almost touching the second sensor 30. For example, when a user places his or her hand within the dispensing area 18, the hand is typically in a cup-like position, and the fingertips of the user's hand are typically close to (e.g., almost touching) an area surrounding a back portion 20*b* of the outlet 20. The second sensor 30 may be strategically placed in the area where a user's fingertips are most likely to be placed, therefore, in order to obtain optimum results when the second sensor 30 is used. For example, with reference to FIG. 13, the antenna 48 of the second sensor 30" may be configured (e.g. the corresponding wires and/or conductive plate (such as in other examples shown herein)) so as to form a sensing field 58 corresponding to the dispensing area 18.

FIG. 14 illustrates a schematic block diagram of various components of an example fluid dispenser 100. The fluid dispenser 100 includes a dispensing mechanism 116 that is positioned and configured to cause fluid to dispense along a dispensing pathway from a reservoir 114 through a dispense outlet 118. The fluid dispenser 100 includes a controller 102 with a memory 108, and a power source 110. The controller 102 may be configured to operate the dispensing mechanism 116 according to data received from either a first sensor 104 or a second sensor 106, or both, such as described herein. For example, the controller 102 may be configured to operate in a first state that uses the first sensor 104 to determine whether or not to cause a dispense based on the first type of input (e.g., with the dispensing mechanism 116). Further, the controller 102 may actuate the first sensor 104 (e.g., the receiver) to make a determination as to whether the first sensor 104 is in an unreliable state. If the first sensor 104 is determined to be in the unreliable state, the controller 102 may be configured to then transition to a second state of using the second sensor 106 to determine whether or not to cause the dispense based on the second type of input. In some embodiments, once the controller has transitioned to using the second sensor 106, the controller 102 may continue to monitor an adverse environmental condition, for example, a saturation level of ambient light using the first sensor 104, and the controller 102 may continue to use the second sensor 106 until the adverse environmental condition returns to a desired level, at which time the controller 102 may switch back to the first state to use the first sensor 104. The controller 102 may also have communications with other system(s)/sensor(s) 112, which may include external communications (e.g., to remote servers, etc.). In other embodiments, the controller 102 may be configured in any other way so as to enable object detection in adverse as well as ideal environmental conditions.

Figure 15:
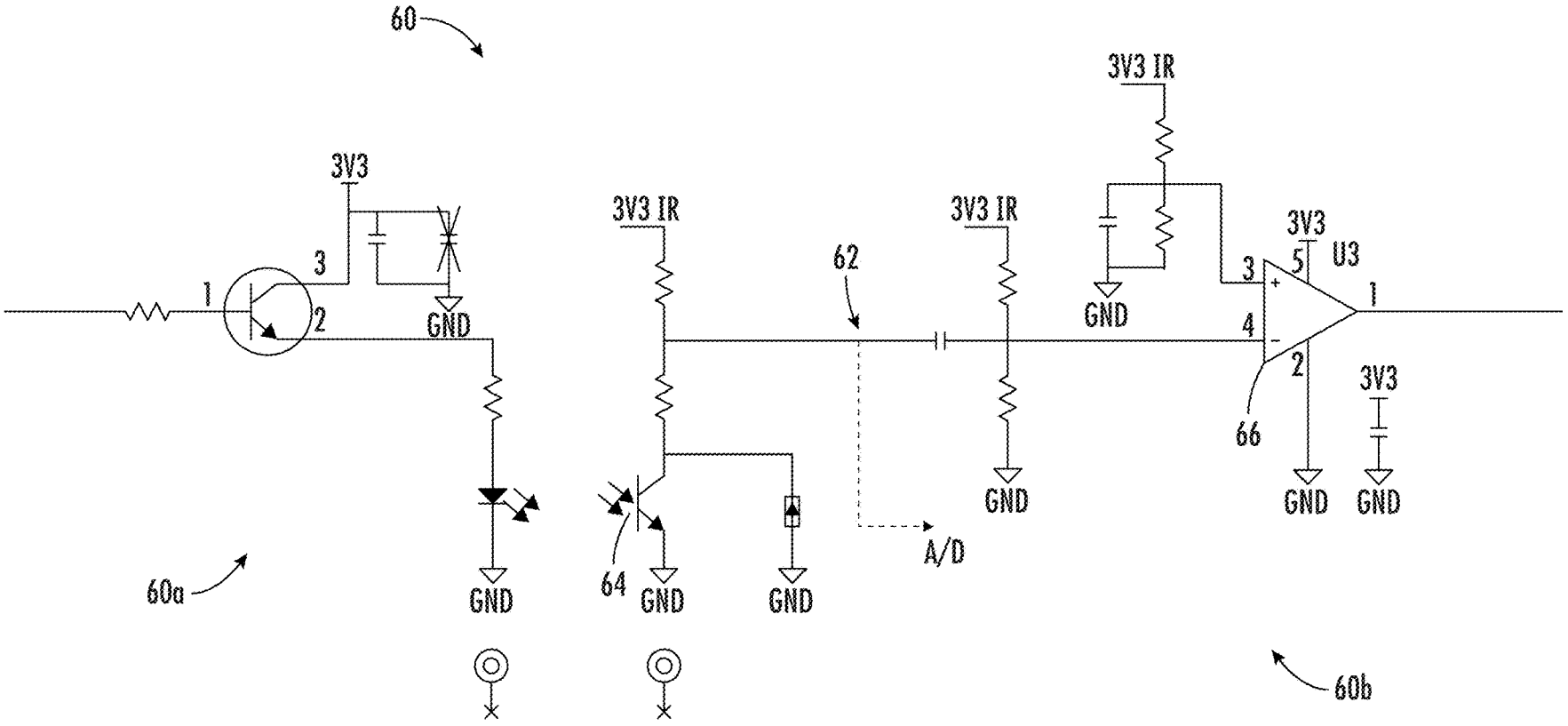
FIG. 15 shows an example circuit schematic related to infrared sensing and ambient light detection, in accordance with some example embodiments described herein.

An example circuit 60 of the first sensor 28 is illustrated in FIG. 15, when the first sensor is configured as an infrared sensor. The circuit 60 includes a transmitter side 60*a* and a receiver side 60*b*. The receiver side 60*b* is configured to receive pulse receipts, and a voltage level of the receiver side 60*b* is adjusted based on the intensity of the pulse receipts. For example, a detected pulse receipt drops the voltage level along the receiver side 60*b*. In this regard, when a detected pulse receipt drops the voltage of the circuit 60 below the predetermined threshold, a comparator 66 within the circuit may briefly output a digital "HI," indicating that a pulse receipt was detected. Thus, when ambient infrared light (e.g., sunlight, infrared noise) increases enough to saturate the circuit 60, the circuit 60 may not automatically detect the saturation, as it may only capture "HI-LO" light transitions (pulse counts). That is, the circuit 60 would fail in a saturated ambient light setting due to its inability to detect a transition from "HI" to "LO" (or "LO" to "HI") because the resultant voltage drop due to the actual user's hand would not register. To solve this problem, the controller may measure the analog signal of the receiver 64 to determine if the circuit is near saturation. The ambient light measurement may then be used to determine if the circuit is near saturation, and the controller may switch between the appropriate sensing methods (e.g., infrared or capacitive) accordingly.

In some embodiments, the controller may be configured to cause an actuation of the first sensor 28 (e.g., the receiver) to determine whether the first sensor 28 is in an unreliable state before proceeding with using the first sensor 28 to determine whether to initiate a dispense based on the first type of input. For example, the fluid dispenser 10 may be configured to apply a voltage to the receiver side 60*b* of the circuit 60 before determining whether to operate using the first sensor 28. The controller of the fluid dispenser 10 may then be configured to measure an analog signal of a receiver 64 within the circuit 60. For example, the analog signal may be measured at a point 62 within the circuit 60. The analog signal may vary depending on the amount of ambient light sensed by the receiver 64. The controller may then compare the analog signal to a predetermined threshold in order to determine whether the circuit 60 is unreliable (e.g., using an A/D converter or other voltage measuring approach). When the analog signal does not exceed the predetermined threshold, the controller may determine that the first sensor 28 is in the reliable state. When the analog signal exceeds the predetermined threshold, the controller may determine that the first sensor 28 is in the unreliable state. Notably, while the above embodiment is described where the analog signal satisfying the threshold equates to the first sensor being in the reliable state, the reverse could be true, such that not exceeding the threshold may correspond to the first sensor being in the unreliable state.

In this regard, in some embodiments, the analog signal may indicate a voltage level, and the predetermined threshold may be one or more voltage levels. For example, the predetermined threshold for an unreliable state may be 1.6 volts, and for a reliable state may be 3 volts. In such a case, the controller may be configured to determine that the first sensor 28 is unreliable when the measured voltage of the analog signal falls below 1.6 volts. Further, the controller may be configured to make a later determination that the first sensor 28 is reliable when the measured voltage of the analog signal exceeds 3 volts. In some embodiments, hysteresis may be used between voltage levels, meaning that the last active sensor may remain active between voltage zones. In other embodiments, the predetermined threshold may be any other value, or the predetermined threshold may be in units other than voltage. Further, the analog signal may make any other indication, such as one that is different from a voltage level.

As noted herein, in instances in which the controller of the fluid dispenser 10 determines that the circuit 60 is reliable, the controller may cause the fluid dispenser 10 to operate using sense data from the first sensor 28 and not the second sensor 30. In some such embodiments, the controller may cause the first sensor 28 to operate by emitting sequences of pulses and subsequently detecting pulse receipts. For example, the first sensor 28 may operate using a dispense determination method, in which pulses may be emitted at different frequencies and/or in different stages. When pulse receipts are detected in a proper manner and/or sequence, the first sensor 28 may cause the controller to dispense a portion of fluid from the reservoir 24. Such a specific confirmation approach may be useful in confirming a proper dispense request, particularly in uncertain environmental conditions. In this regard, the dispense determination method of some embodiments further works with the two sensor approach of some example fluid dispensers to provide an even more robust sensing and dispensing approach.

Figure 16:
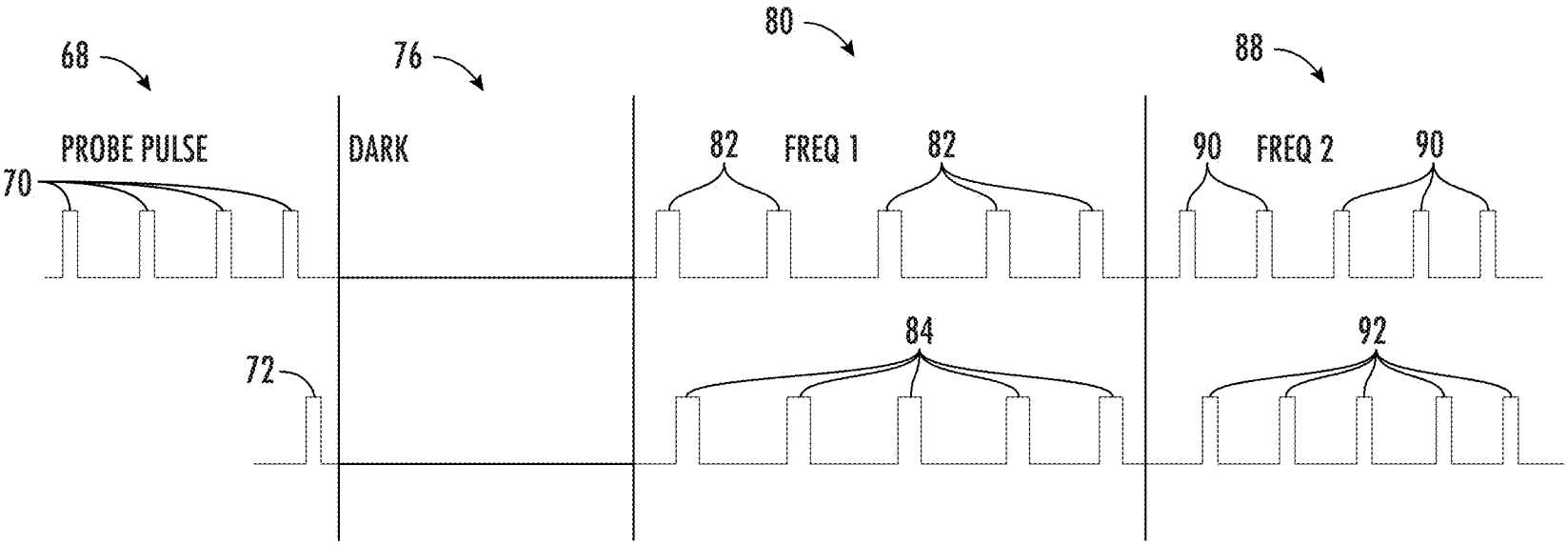
FIG. 16 shows an example dispense determination method and an example response sequence in which an object is detected for an example infrared sensor, in accordance with some example embodiments described herein.
Figure 17:
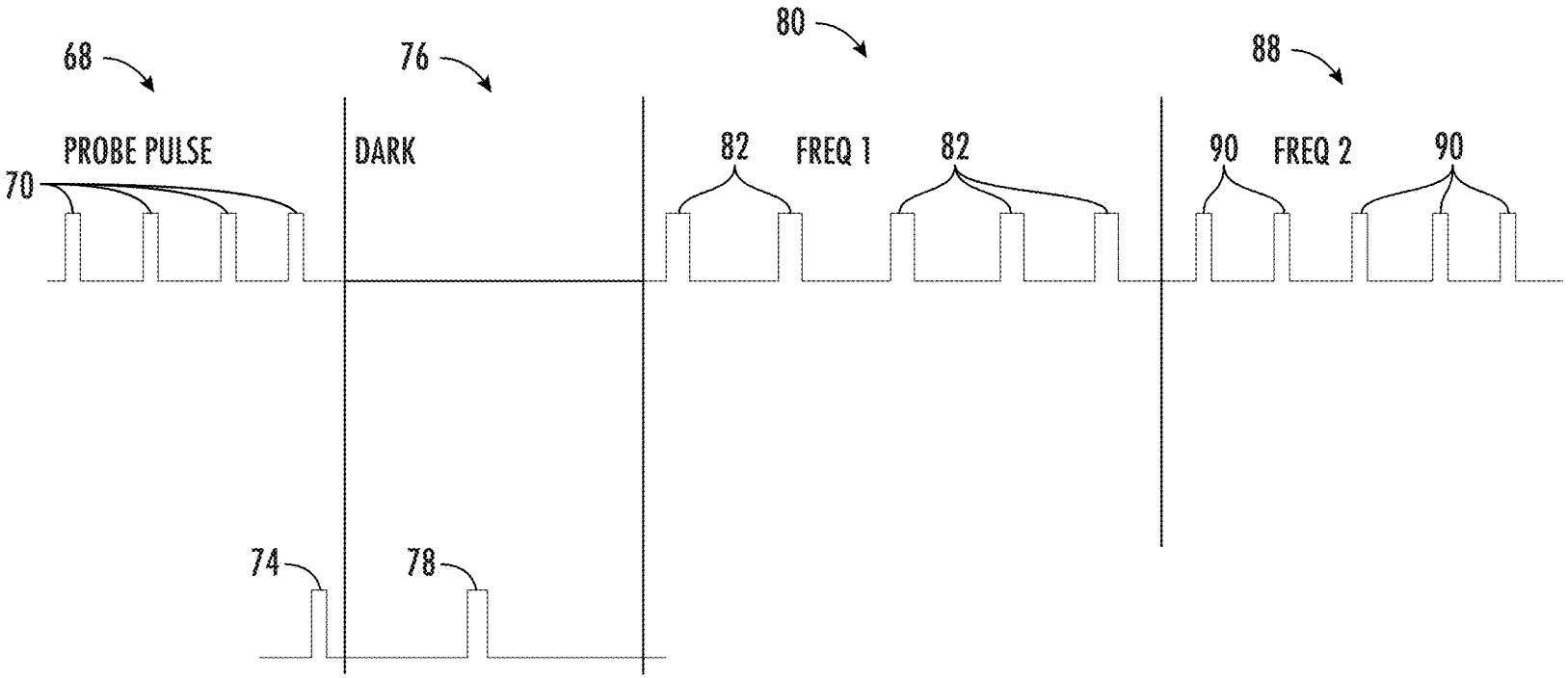
FIG. 17 shows the example dispense determination method and another example response sequence in which an object is not detected, in accordance with some example embodiments described herein.

For example, as depicted in FIGS. 16-17, the dispense determination method may include a probe pulse stage 68, in which the controller may cause activation of a transmitter of the first sensor 28 to initiate one or more probe pulses 70. Receipt of at least one pulse receipt 72 or 74 at a receiver 64 of the first sensor 28 may indicate that the user desires a dispensed portion of the fluid from the reservoir 24. For example, placement of the user's hand or any other object within the dispensing area 18 may cause at least one pulse receipt 72 or 74 to be detected at the receiver 64. That is, the placement of a human hand or object within the dispensing area 18 when the one or more probe pulses 70 are emitted may cause the one or more probe pulses 70 to reflect off the human hand or object and create the at least one pulse receipt 72 or 74 (e.g., the one or more probe pulses 70 reflect off the human hand or object and return to the receiver 64 of the first sensor 28). Alternatively, when no human hand or object is placed within the dispensing area 18 when the one or more probe pulses 70 are emitted, the one or more probe pulses 70 may not reflect off anything, and no pulse receipt may be formed.

If the receiver 64 does not detect at least one pulse receipt 72 or 74, the dispense determination method may return a determination that no object has been detected. If, however, the at least one pulse receipt 72 or 74 is received at the receiver 64 during the probe pulse stage 68, then the dispense determination method may proceed into a dark stage 76. During the dark stage 76, the controller may be configured such that no probe pulses are emitted for a predetermined amount of time. In some embodiments, the dark stage 76 may be approximately one millisecond in duration. In other embodiments, the dark stage 76 may be any other length in duration.

If at least one pulse receipt 78 is detected during the dark stage 76, such as is shown in FIG. 17, the dispense determination method may return a determination that no object has been detected. Since no probe pulses are emitted during the dark stage 76, the one or more pulse receipts 78 may indicate an abnormality. For example, noise within an environment may cause one or more pulse receipts 78 (or imitations thereof in this case) to be detected by the receiver 64, and the dark stage 76 may prevent an unwanted dispense in response to such noise.

If no probe pulse receipts are detected during the dark stage 76 after the predetermined amount of time has passed, such as shown in FIG. 16, the dispense determination method may proceed to a first frequency stage 80. During the first frequency stage 80, the dispense determination method may cause an activation of the transmitter of the first sensor 28 to initiate one or more pulses 82. In some embodiments, the one or more pulses 82 may be emitted at a first frequency. Receipt of at least one pulse receipt 84 at a receiver 64 of the first sensor 28 may indicate that the user desires a dispensed portion of the fluid from the reservoir 24. For example, a continued placement of the user's hand or any other object within the dispensing area 18 may cause at least one pulse receipt 84 to be detected at the receiver 64. That is, the placement of a human hand or object within the dispensing area 18 when the one or more probe pulses 82 are emitted may cause the at one or more probe pulses 82 to reflect off the human hand or object and create the at least one pulse receipt 84. Alternatively, when no human hand or object is placed within the dispensing area 18 when the one or more probe pulses 82 are emitted, the one or more probe pulses 82 may not reflect off anything, and no pulse receipt may be formed.

If the receiver 64 does not detect at least one pulse receipt 84, the dispense determination method may return a determination that no object has been detected. If, however, the receiver 64 receives at least one pulse receipt 84 in response to the one or more pulses 82 during the first frequency stage 80, the dispense determination method may either proceed to a second frequency stage 88 or cause the dispensing mechanism to actuate a dispense of the fluid from the reservoir 24. For example, in the example shown in FIG. 16, the detection of the pulse receipts 84 causes the controller to proceed to the second frequency stage 88. In some embodiments, the at least one pulse receipt 84 that is detected must have the same frequency as the one or more probe pulses 82 that were emitted during the first frequency stage 80. Further, in some embodiments, the number of pulse receipts 84 that are detected must equal the number of pulses 82 that were emitted. In other embodiments, the frequency of the at least one pulse receipt 84 may not have to match the frequency of the pulses 82, and the number of pulse receipts 84 may not have to match the number of pulses 82, for the controller to either proceed to the second frequency stage 88 or cause the dispensing mechanism to actuate a dispense of the fluid from the reservoir 24. If the receiver 64 does not detect at least one pulse receipt 84, the dispense determination method may return a determination that no object has been detected. For example, if a user places his or her hand within the dispensing area 18 and then quickly removes his or her hand, the dispense determination method may successfully proceed through the probe pulse stage 68 and the dark stage 76 but fail to proceed through the first frequency stage 80, because of the removal of the hand. This may prevent a dispense of the fluid when the hand has been placed within the dispensing area 18 but then quickly removed before the dispense determination method has reached completion. In other embodiments, other scenarios may cause the dispense determination method to fail to detect at least one pulse receipt 84 during the first frequency stage 80.

In embodiments in which the receipt, such as at the receiver 64 of the first sensor 28, of the one or more pulse receipts 84 causes the controller to proceed to the second frequency stage 88, the detection of the one or more pulse receipts 84 may cause the controller to cause an activation of the transmitter of the first sensor 28 to initiate one or more pulses 90. The one or more pulses 90 may be emitted at a second frequency. In some embodiments, the second frequency may be different than the first frequency. Receipt of at least one pulse receipt 92 at a receiver 64 of the infrared sensor 28 may indicate that the user desires a dispensed portion of the fluid from the reservoir 24. For example, a continued placement of the user's hand or any other object within the dispensing area 18 may cause at least one pulse receipt 92 to be detected at the receiver 64. That is, the placement of a human hand or object within the dispensing area 18 when the one or more probe pulses 90 are emitted may cause the at one or more probe pulses 90 to reflect off the human hand or object and create the at least one pulse receipt 92. Alternatively, when no human hand or object is placed within the dispensing area 18 when the one or more probe pulses 90 are emitted, the one or more probe pulses 90 may not reflect off anything, and no pulse receipt may be formed.

If the controller detects at least one pulse receipt 92 in response to the one or more pulses 90, the controller may cause the dispensing mechanism to actuate a dispense of the fluid from the reservoir 24. For example, in the example shown in the second row of FIG. 16, the detection of the at least one pulse receipt 92 causes the controller to detect an object and thus cause a dispense of the fluid from the reservoir 24. In some embodiments, the at least one pulse receipt 92 must have the same frequency as the one or more probe pulses 90 that were emitted during the second frequency stage 88. Further, in some embodiments, the number of probe receipts 92 that are detected must equal the number of pulses 90 that were emitted. In other embodiments, the frequency of the at least one pulse receipt 92 may not have to match the frequency of the pulses 90, and the number of pulse receipts 92 may not have to match the number of pulses 90, for the controller to cause the dispensing mechanism to actuate a dispense of the fluid from the reservoir 24. If the controller does not detect at least one pulse receipt 92, the dispense determination method may return a determination that no object has been detected (and thus refrain from causing a dispense of the fluid from the reservoir 24). For example, if a user places his or her hand within the dispensing area 18 and then quickly removes his or her hand, the dispense determination method may successfully proceed through the probe pulse stage 68, dark stage 76, and first frequency stage 80, but fail to proceed through the second frequency stage 88, because of the removal of the hand. This may prevent a dispense of the fluid when the hand has been placed within the dispensing area 18 but then quickly removed before the dispense determination method has reached completion. In other embodiments, other scenarios may cause the dispense determination method to fail to detect at least one pulse receipt 92 during the second frequency stage 88.

In instances in which the controller of the fluid dispenser 10 determines that the circuit 60 is unreliable, the controller may cause the fluid dispenser 10 to operate using data from the second sensor 30 and not the first sensor 28. In some embodiments, the controller may cause the second sensor 30 to operate according to a secondary determination method, for example a capacitive dispense determination method. To explain, the capacitive dispense determination method may begin by initiating application of a voltage to the second sensor 30 such that the second sensor 30 emits a capacitance sense field. The capacitive dispense determination method may then include detecting a capacitance within the capacitance sense field. For example, the controller of the fluid dispenser 10 may be configured to detect the capacitance of a human hand or of any other object. The capacitive dispense determination method may then compare the detected capacitance to a predetermined capacitance threshold. In some embodiments, the predetermined capacitance threshold may correspond to a dielectric constant of a human hand or of any other object. When the detected capacitance is within the predetermined capacitance threshold, the controller may cause activation of the dispensing mechanism to cause a portion of the fluid in the reservoir 24 to be dispensed.

Some embodiments provide methods, apparatuses and computer program products for providing dispensing of fluid according to various embodiments described herein. Various examples of the operations performed in accordance with embodiments of the present invention will now be provided with reference to FIG. 18.

Figure 18:
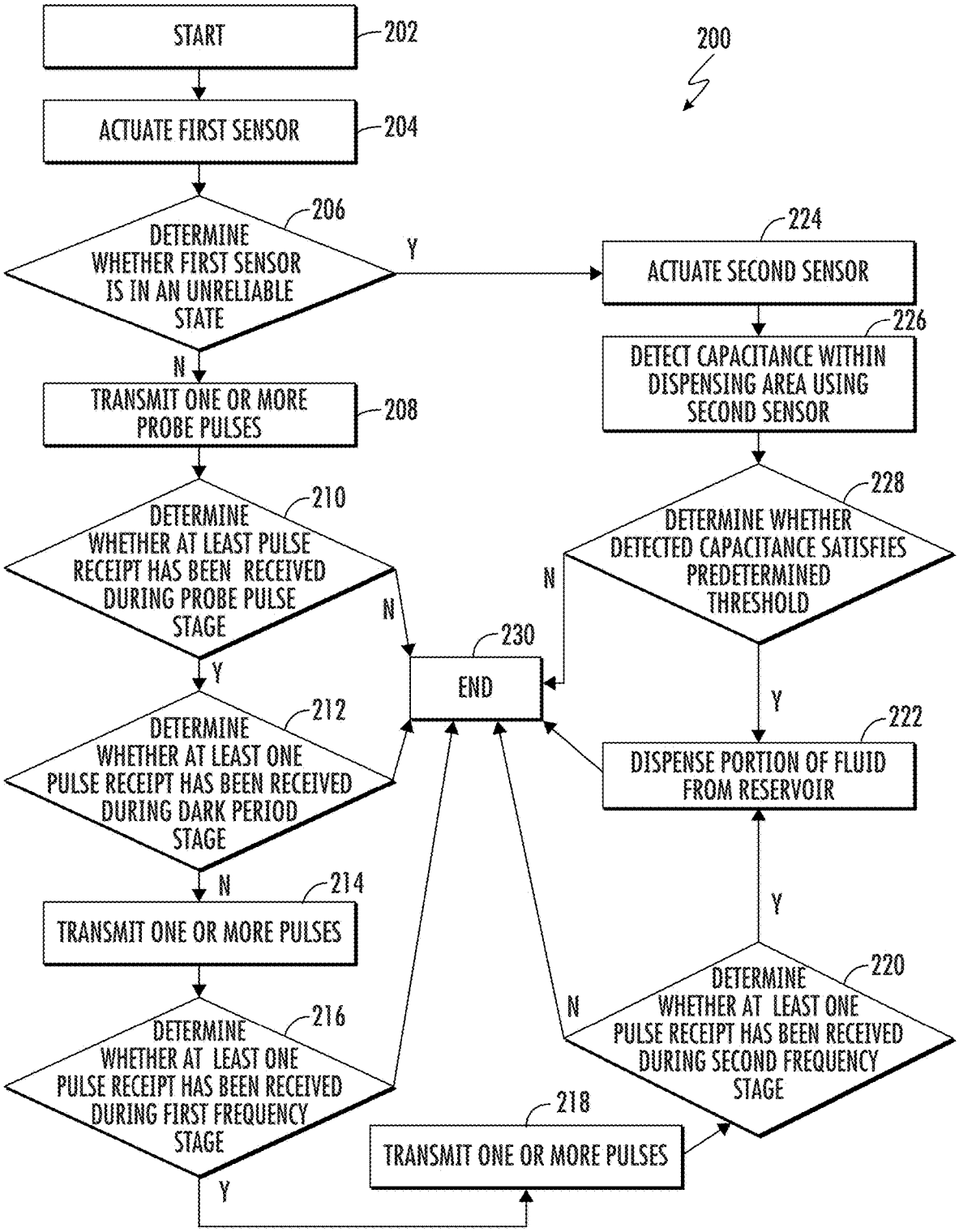
FIG. 18 illustrates an example flowchart for an example method for dispensing, in accordance with some example embodiments described herein.

FIG. 18 illustrates a flowchart according to an example method 200 of operation for a dispenser according to example embodiments described herein. The operations illustrated in and described with respect to FIG. 18 may, for example, be performed by, with the assistance of, and/or under the control of one or more of the components and/or systems/devices of example fluid dispensers described herein, such as fluid dispensers 10 and 100.

The operation flow begins at operation 202. At operation 204, the method comprises actuating a first sensor, for example first sensor 28. At operation 206, it is determined whether the first sensor is in an unreliable state (e.g., partially or fully saturated with ambient light, has a loss of power, or is otherwise unable to perform a desired sensing operation). In some embodiments, the operation 206 may comprise measuring a voltage level of a receiver within a circuit, as described herein with respect to fluid dispenser 10. If the first sensor is determined to be in a reliable state (e.g., not saturated, etc.), the method may proceed to operation 208 and transmit one or more probe pulses. If, however, the first sensor is determined to be in an unreliable state, the method may proceed to operation 224 and actuate a second sensor, which, in some embodiments, may be the second sensor 30.

If the first sensor is determined to be in a reliable state and the method proceeds to operation 208 in which it transmits one or more probe pulses, the method may then proceed to operation 210 to determine whether at least one pulse receipt has been received during a probe pulse stage. If no probe pulse receipts are received during the probe pulse stage, the method may proceed to operation 230 and end without a dispense occurring (and, for example, may return to operation 202 to start again). If at least one probe pulse receipt is received during the probe pulse stage, the method may proceed to operation 212 to determine whether at least one pulse receipt has been received during a dark stage. This may occur, for example, when a human hand or any other object is placed within a dispensing area proximate the first sensor. If at least one pulse receipt is received during the dark stage, the method may proceed to operation 230 and end without a dispense occurring (and, for example, may return to operation 202 to start again). For example, this may happen due to infrared noise or other environmental abnormalities.

If no pulse receipts are received during the dark stage, the method may proceed to operation 214, in which it transmits one or more pulses. For example, the one or more pulses transmitted at operation 214 may be transmitted at a first frequency. Operation 216 may comprise determining whether at least one pulse receipt has been received during a first frequency stage. If no pulse receipts are received during the first frequency stage, the method may proceed to operation 230 and end without a dispense occurring (and, for example, may return to operation 202 to start again). This may occur, for example, if the human hand or other object is no longer within the dispensing area.

If at least one pulse receipt is received during the first frequency stage, however, the method may proceed to operation 218, in which it transmits one or more pulses. For example, the one or more pulses transmitted at operation 218 may be transmitted at a second frequency. In some embodiments, the second frequency may be different than the first frequency. At operation 220, the method may determine whether at least one pulse receipt has been received during a second frequency stage. If no pulse receipts are received during the second frequency stage, the method may proceed to operation 230 and end without a dispense occurring (and, for example, may return to operation 202 to start again). If at least one pulse receipt is received during the second frequency stage, however, the method may proceed to operation 222 and dispense a portion of fluid from a reservoir. The method may then proceed to operation 230 and end (and, for example, may return to operation 202 to start again).

Returning to operation 206, if the first sensor is determined to be in an unreliable state then the method proceeds to operation 224 in which it actuates the second sensor. The method may then proceed to operation 226 to detect a signal level, for example a capacitance within a dispensing area using the second sensor. For example, in some embodiments, the dispensing area may be the dispensing area 18 underneath the outlet 20 of fluid dispenser 10. At operation 228, the method may determine whether the detected signal is within a predetermined signal threshold. For example, the predetermined signal threshold may correspond to the capacitance of a human hand and/or the capacitance(s) of any other object(s). If the detected signal is not within the predetermined signal threshold, the method may proceed to operation 230 and end without a dispense occurring (and, for example, may return to operation 202 to start again). If the detected signal is within the predetermined signal threshold, however, the method may proceed to operation 222 and dispense a portion of fluid from the reservoir. The method may then proceed to operation 230 and end (and, for example, may return to operation 202 to start again).

After the method ends at operation 230, in some embodiments, the method may automatically return to operation 202 and begin again. In other embodiments, the method may proceed straight to operation 206 after reaching operation 230. Further, in some other embodiments, the method may repeat in any other manner, or the method may not repeat at all.

FIG. 18 illustrates an example flowchart of a system, method, and computer program product according to various example embodiments described herein. It will be understood that each block of the flowchart, and combinations of blocks in the flowchart, may be implemented by various means, such as hardware and/or a computer program product comprising one or more computer-readable mediums having computer readable program instructions stored thereon. For example, one or more of the procedures described herein may be embodied by computer program instructions of a computer program product. In this regard, the computer program product(s) which embody the procedures described herein may be stored by, for example, the memory and executed by, for example, the controller(s) described herein. As will be appreciated, any such computer program product may be loaded onto a computer or other programmable apparatus to produce a machine, such that the computer program product including the instructions which execute on the computer or other programmable apparatus creates means for implementing the functions specified in the flowchart block(s). Further, the computer program product may comprise one or more non-transitory computer-readable mediums on which the computer program instructions may be stored such that the one or more computer-readable memories can direct a computer or other programmable device to cause a series of operations to be performed on the computer or other programmable apparatus to produce a computer-implemented process such that the instructions which execute on the computer or other programmable apparatus implement the functions specified in the flowchart block(s).

CONCLUSION

Many modifications and other embodiments of the inventions set forth herein may come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

That which is claimed:

1. A dispenser comprising:

a reservoir configured to store a fluid;

a dispensing mechanism configured to dispense a portion of the fluid from the reservoir through an outlet;

a first sensor configured to sense an object;

a second sensor configured to sense the object, wherein the second sensor is different than the first sensor; and a controller configured to:

receive data from the first sensor, wherein the data is indicative of an environmental condition;

determine whether the first sensor is in an unreliable state based on the data received from the first sensor; and in an instance in which the first sensor is determined to be in the unreliable state, cause the dispensing mechanism to operate to dispense the portion of the fluid in response to sensing the object via the second sensor.

2. The dispenser of claim 1, wherein sensing the object via the second sensor comprises detecting a change within a sensing field of the second sensor.

3. The dispenser of claim 1, wherein the controller is configured to determine whether the first sensor is in the unreliable state by:

determining if a level of ambient light in an environment surrounding the dispenser exceeds a predetermined threshold; and in an instance in which the level of ambient light exceeds the predetermined threshold, determining that the first sensor is in the unreliable state.

4. The dispenser of claim 3, wherein determining if the level of ambient light in the environment surrounding the dispenser exceeds the predetermined threshold comprises measuring an analog signal of a receiver within a circuit of the first sensor, wherein the analog signal varies depending on an amount of ambient light sensed by the receiver; and comparing the analog signal to a predetermined range.

5. The dispenser of claim 4, wherein the analog signal indicates a voltage level, and wherein the predetermined range is a voltage range.

6. The dispenser of claim 1, wherein the controller is further configured to:

determine that the first sensor is in a reliable state by receiving a signal pulse corresponding to sensing the object at the first sensor; and cause, in response to receiving the signal pulse at the first sensor, the dispensing mechanism to operate to dispense the portion of the fluid.

7. The dispenser of claim 1, wherein the second sensor is positioned proximate the outlet.

8. The dispenser of claim 1, wherein the first sensor is one of an infrared sensor, a time-of-flight sensor, a break beam sensor, an optical sensor, a capacitive sensor, an ultrasonic sensor, a radar sensor, a LiDAR sensor, an image sensor, a passive infrared sensor, or a camera.

9. The dispenser of claim 8, wherein the second sensor is a capacitive sensor.

10. A dispenser comprising:

a reservoir configured to store a fluid;

a dispensing mechanism configured to dispense a portion of the fluid from the reservoir through an outlet;

a first sensor configured to sense an object;

a second sensor configured to sense the object, wherein the second sensor is a type of sensor that is different than the first sensor; and a controller configured to:

determine that the first sensor is in an unreliable state; and in an instance in which the first sensor is determined to be in the unreliable state, cause the dispensing mechanism to dispense the portion of the fluid based on detection of the object by the second sensor and not based on detection of the object by the first sensor.

11. The dispenser of claim 10, wherein the second sensor is positioned proximate the outlet.

12. The dispenser of claim 10, wherein the controller is configured to determine that the first sensor is in the unreliable state by:

determining if a level of ambient light in an environment surrounding the dispenser exceeds a predetermined threshold; and in an instance in which the level of ambient light exceeds the predetermined threshold, determining that the first sensor is in the unreliable state.

13. The dispenser of claim 12, wherein determining if the level of ambient light in the environment surrounding the dispenser exceeds the predetermined threshold comprises measuring an analog signal of a receiver within a circuit of the first sensor, wherein the analog signal varies depending on an amount of ambient light sensed by the receiver; and comparing the analog signal to a predetermined range.

14. The dispenser of claim 13, wherein the analog signal indicates a voltage level, and wherein the predetermined range is a voltage range.

15. The dispenser of claim 10, wherein the controller is further configured to determine that the first sensor is in a reliable state and thereafter cause the dispensing mechanism to dispense the portion of the fluid based on receiving a signal pulse at the first sensor and not based on the detection of the object by the second sensor.

16. The dispenser of claim 10, wherein the first sensor is one of an infrared sensor, a time-of-flight sensor, a break beam sensor, an optical sensor, a capacitive sensor, an ultrasonic sensor, a radar sensor, a LiDAR sensor, an image sensor, a passive infrared sensor, or a camera.

17. The dispenser of claim 16, wherein the second sensor is a capacitive sensor.

18. A method for dispensing, the method comprising:

determining whether a first sensor is in a reliable state or an unreliable state;

in response to determining that the first sensor is in the reliable state, initiating a dispensing mechanism to dispense a portion of a fluid based on sensing an object by the first sensor and not a second sensor; and in response to determining that the first sensor is in the unreliable state, initiating the dispensing mechanism to dispense the portion of the fluid based on sensing the object by the second sensor and not the first sensor, wherein the first sensor and the second sensor are different.

19. The method of claim 18, wherein the first sensor is one of an infrared sensor, a time-of-flight sensor, a break beam sensor, an optical sensor, a capacitive sensor, an ultrasonic sensor, a radar sensor, a LiDAR sensor, an image sensor, a passive infrared sensor, or a camera.

20. The method of claim 19, wherein in response to determining that the first sensor is in the unreliable state, the method further comprises:

detecting a change within a sensing field of the second sensor, wherein the change indicates the object is within the sensing field; and causing, in response to sensing the object within the sensing field, the dispensing mechanism to operate to dispense the portion of the fluid.

21. The method of claim 20, wherein the second sensor is positioned proximate the outlet.

22. The method of claim 21, wherein the second sensor is a capacitive sensor.

23. A dispenser comprising:

a reservoir configured to house a fluid;

a dispensing mechanism configured to dispense a portion of the fluid from the reservoir through an outlet;

a first sensor configured to sense a presence of an object;

a second sensor positioned proximate the outlet and configured to sense the presence of the object, wherein the second sensor is a type of sensor that is different than the first sensor; and a controller configured to:

operate according to a first state by using the first sensor to determine whether to initiate a dispense of the portion of the fluid;

operate according to a second state by using the second sensor to determine whether to initiate a dispense of the portion of the fluid; and determine that the first sensor is in an unreliable state and cause operation according to the second state.

24. The dispenser of claim 23, wherein the first sensor is one of an infrared sensor, a time-of-flight sensor, a break beam sensor, an optical sensor, a capacitive sensor, an ultrasonic sensor, a radar sensor, a LiDAR sensor, an image sensor, a passive infrared sensor, or a camera.

25. The dispenser of claim 24, wherein the second sensor is a capacitive sensor.

26. The dispenser of claim 25, wherein the second sensor is positioned partially around the outlet.

* * * * *